US009168626B2

(12) United States Patent
Dovel et al.

(10) Patent No.: US 9,168,626 B2
(45) Date of Patent: Oct. 27, 2015

(54) CUTTING TOOL SHARPENER

(71) Applicant: Professional Tool Manufacturing, LLC, Ashland, OR (US)

(72) Inventors: Daniel T. Dovel, Shady Cove, OR (US); Christopher T. DeLorenzo, Ashland, OR (US); Steven J. Miner, Ashland, OR (US)

(73) Assignee: Professional Tool Manufacturing LLC, Ashland, OR (US)

( * ) Notice: Subject to any disclaimer, the term of this patent is extended or adjusted under 35 U.S.C. 154(b) by 0 days.

(21) Appl. No.: 13/969,955

(22) Filed: Aug. 19, 2013

(65) Prior Publication Data

US 2014/0024300 A1 Jan. 23, 2014

Related U.S. Application Data

(62) Division of application No. 11/917,647, filed as application No. PCT/US2006/004882 on Dec. 21, 2006, now Pat. No. 8,512,103.

(60) Provisional application No. 60/782,843, filed on Mar. 16, 2006.

(51) Int. Cl.

| | |
|---|---|
| ***B24B 3/34*** | (2006.01) |
| ***B24B 3/54*** | (2006.01) |
| ***B24B 9/04*** | (2006.01) |
| ***B24B 55/02*** | (2006.01) |
| ***B24B 3/36*** | (2006.01) |

(52) U.S. Cl.

CPC ... *B24B 3/36* (2013.01); *B24B 3/34* (2013.01); *B24B 3/54* (2013.01); *B24B 9/04* (2013.01); *B24B 55/02* (2013.01)

(58) Field of Classification Search

CPC ..... B24B 7/04; B24B 3/34; B24B 3/36; B24B 3/48; B24B 3/54; B24B 3/58; B24B 3/60; B24B 37/12; B24B 9/04; B24B 41/06; B24B 55/02; B24B 55/03; B24B 55/052

USPC ..... 451/261, 262, 267, 278, 293, 367, 371, 451/449, 451, 457

See application file for complete search history.

(56) References Cited

U.S. PATENT DOCUMENTS

| | | | | |
|---|---|---|---|---|
| 1,581,919 A | | 4/1926 | Case | |
| 2,814,171 A | | 11/1957 | Bogart | |
| 3,420,010 A | | 1/1969 | Tobey | |
| 4,513,538 A | * | 4/1985 | Wolters et al. | 451/7 |
| 4,607,459 A | * | 8/1986 | Rees | 451/241 |
| 4,627,194 A | | 12/1986 | Friel | |

(Continued)

FOREIGN PATENT DOCUMENTS

| | | | | |
|---|---|---|---|---|
| CN | 2325161 Y | | 6/1999 | |
| GB | 844438 | * | 8/1960 | B02C 00/00 |

(Continued)

*Primary Examiner* — Eileen Morgan

(74) *Attorney, Agent, or Firm* — Hall Estill Attorneys at Law

(57) ABSTRACT

A tool sharpening assembly suitable for sharpening cutting tools. In accordance with some embodiments, the apparatus has a rotatable abrasive surface, and a tool support structure which contactingly supports a body portion of a tool while a cutting surface of the tool is presented against the abrasive surface during a sharpening operation. A cooling mechanism operates to reduce a temperature of the tool.

20 Claims, 24 Drawing Sheets

(56) References Cited

U.S. PATENT DOCUMENTS

| | | | | | |
|---|---|---|---|---|---|
| 4,961,288 | A | | 10/1990 | Ketteringham | |
| 4,996,797 | A | | 3/1991 | Laughton | |
| 5,127,196 | A | * | 7/1992 | Morimoto et al. | 451/7 |
| 5,251,407 | A | | 10/1993 | Afshar | |
| 5,311,703 | A | | 5/1994 | Ketteringham | |
| 5,718,620 | A | * | 2/1998 | Tanaka et al. | 451/288 |
| 5,957,750 | A | * | 9/1999 | Brunelli | 451/7 |
| 6,007,415 | A | | 12/1999 | Van Osenbruggen | |
| 6,071,183 | A | | 6/2000 | Havins | |
| 6,620,034 | B2 | * | 9/2003 | Shih et al. | 451/288 |
| 6,926,596 | B1 | * | 8/2005 | Tarris | 451/367 |
| 7,169,014 | B2 | * | 1/2007 | Taylor et al. | 451/6 |
| 7,281,969 | B2 | * | 10/2007 | Naples et al. | 451/371 |
| 2006/0258271 | A1 | | 11/2006 | Naples et al. | |
| 2007/0218819 | A1 | | 9/2007 | Schwaiger et al. | |
| 2009/0124181 | A1 | | 5/2009 | Levsen | |

FOREIGN PATENT DOCUMENTS

| | | | | | |
|---|---|---|---|---|---|
| JP | 58143948 | A | * | 8/1983 | B24B 7/10 |
| WO | 2004014605 | A1 | | 2/2004 | |

* cited by examiner

CUTTING TOOL SHARPENER

RELATED APPLICATIONS

The present application is a divisional of copending U.S. patent application Ser. No. 11/917,647 filed Dec. 14, 2007 (issuing on Aug. 20, 2013 as U.S. Pat. No. 8,512,103) which makes a claim of priority under 35 U.S.C. §371 to PCT Application PCT/US2006/048882 filed Dec. 21, 2006, and a claim of priority under 35 U.S.C. §119(e) to U.S. Provisional Patent Application No. 60/782,843 filed Dec. 21, 2006.

FIELD OF THE INVENTION

The claimed invention relates generally to the field of tool sharpeners and more particularly, but not by way of limitation, to an apparatus and method for sharpening a cutting tool.

BACKGROUND

Cutting tools are often provided with a laterally extending cutting (chisel-type) edge. This cutting edge is useful, for example, in planing a surface such as a wooden board, or cutting a brick or other member through the application of a sharp impulse to the tool opposite the cutting edge.

The cutting edge is often defined at the intersection of a back surface and leading surface (bevel) of the tool. The angle between the respective back and bevel surfaces can vary, with a commonly used angle being on the order of about 25 degrees.

The laterally extending cutting edge can be substantially linear (straight), or can be curvilinear (rounded). These latter tools are particularly useful as woodworking and carving tools, which come in a large number of shapes and sizes.

While such tools have found great popularity and utility in a variety of applications, one problem that often arises is that, after repeated use, the cutting edge can become dull and/or damaged. It is therefore often desirable to periodically sharpen the tool in an attempt to provide a uniform, sharp and well defined cutting edge for the tool.

A variety of sharpening methodologies and devices has been proposed in the art to sharpen such tools. While operable, a number of limitations have been found with these prior art approaches, including the generation of relatively large burrs at the cutting edge, the propensity to overheat the tool during the sharpening operation, and the inability to provide a precisely formed cutting edge.

There accordingly remains a continual need for improvements in the art to permit a user to quickly and reliably sharpen cutting tools. It is to these and other improvements that preferred embodiments of the present invention are generally directed.

SUMMARY OF THE INVENTION

Preferred embodiments of the present invention are generally related to a tool sharpening apparatus suitable for sharpening a number of different types of cutting tools.

In accordance with some embodiments, the apparatus generally comprises a rotatable abrasive surface, and a tool support structure which contactingly supports a body portion of a tool while a cutting surface of the tool is presented against the abrasive surface during a sharpening operation. A cooling mechanism operates to reduce a temperature of the tool.

Various other features and advantages of the preferred embodiments of the present invention will be apparent from a review of the following detailed discussion and the associated drawings.

DETAILED DESCRIPTION

Figure 1:
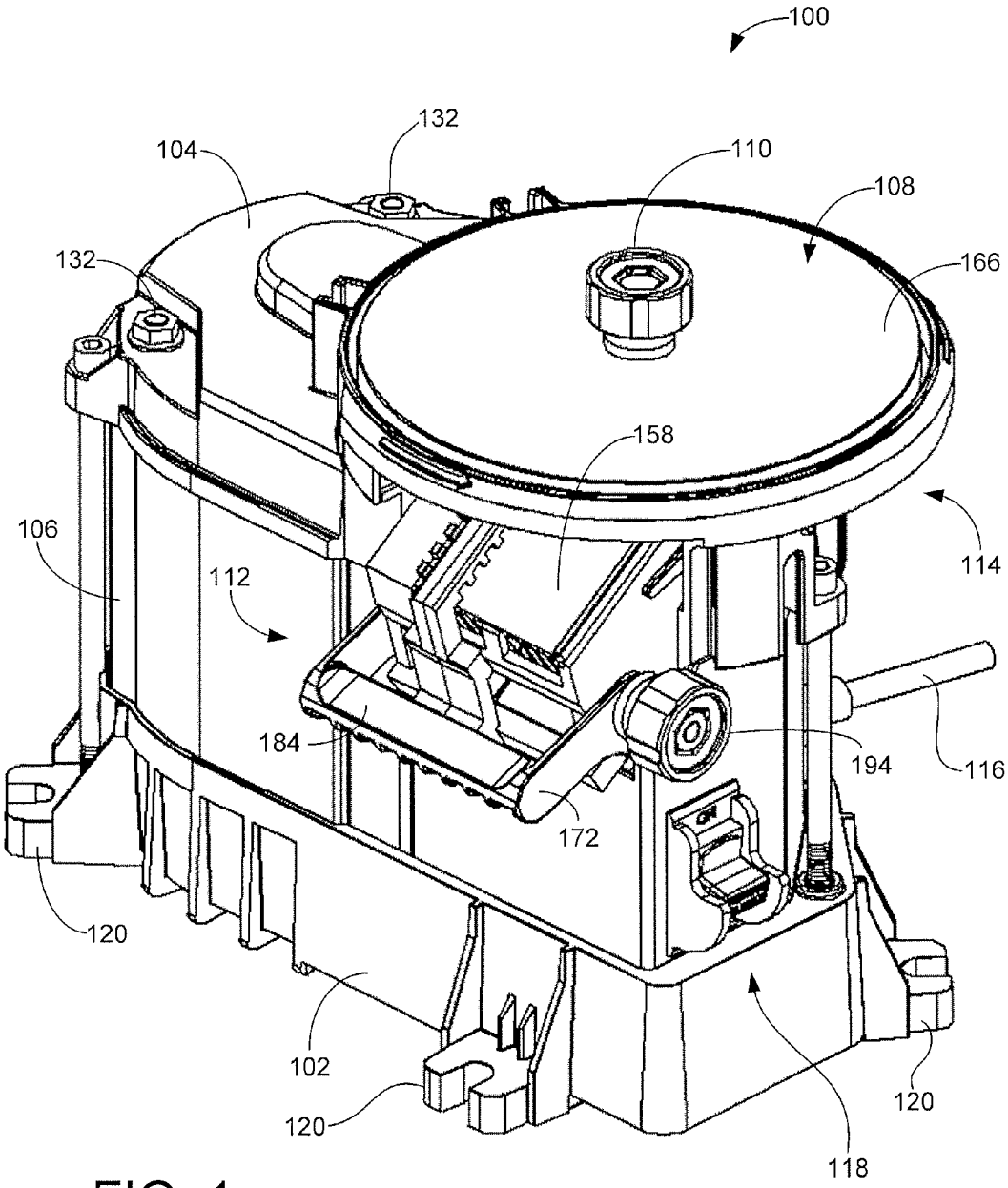
FIG. 1 provides an isometric representation of a tool sharpening assembly constructed in accordance with preferred embodiments of the present invention.

As set forth below, preferred embodiments of the present invention are generally directed to an apparatus for sharpening a cutting tool. The apparatus is exemplified by a tool sharpening assembly 100, as shown in FIG. 1. The assembly 100 includes a number of different features and operational assemblies, each of which will be discussed in turn below.

Overview

Major components of the assembly 100 include a rigid housing formed from a base member 102, top member 104 and circumferentially arrayed sidewall members 106. Preferably, the base member 102 is formed of injection molded, tool grade plastic, the top member 104 is cast aluminum and the sidewall members 106 are formed of aluminum sheeting. A variety of other materials and shapes can be used as desired, however.

An abrasive disc 108 is rotated during operation of the assembly 100 at a suitable speed, such as on the order of about 580 revolutions per minute (rpm). As explained below, the disc 108 preferably comprises a tempered glass disc, preferably on the order of about six (6) inches (150 millimeters, mm) in diameter and about ⅜ inch (10 mm) in thickness. Sheets of coated abrasive are preferably attached to the upper and lower surfaces of the disc, and a threaded fastener 110 is inserted through a central aperture to secure the disc to an underlying spindle (not shown).

Preferably, the sheets of coated abrasive each comprise a substrate backing layer such as paper, fiber, cloth, film, screen, etc. A layer of adhesive is applied to one side of the backing layer, and a layer of abrasive particles of selected grit is affixed to the other side of the backing layer. The layer of adhesive serves to affix the sheet to the disc 108, thereby presenting the outwardly extending abrasive layer for use during the sharpening operation. In some preferred embodiments, the sheets of coated abrasive can be characterized as sheets of sandpaper with adhesive backing.

A first sharpening port is generally denoted at 112. The sharpening port 112, also referred to herein as a "wedge shaped port," is preferably used to provide sharpening of various types of cutting tools in a fast and efficient manner as explained below. A second sharpening port is generally denoted at 114, and this second port 114 is used to sharpen other types of cutting tools, also in a manner to be discussed below.

Other features of interest shown in FIG. 1 include a conventional AC power cord 116 (shown in cutaway fashion) and an on-off power switch 118. U-shaped mounting channels 120 preferably extend from the base member 102 to accommodate fasteners (not shown) which can be used to secure the assembly 100 to an underlying work surface.

Figure 2:
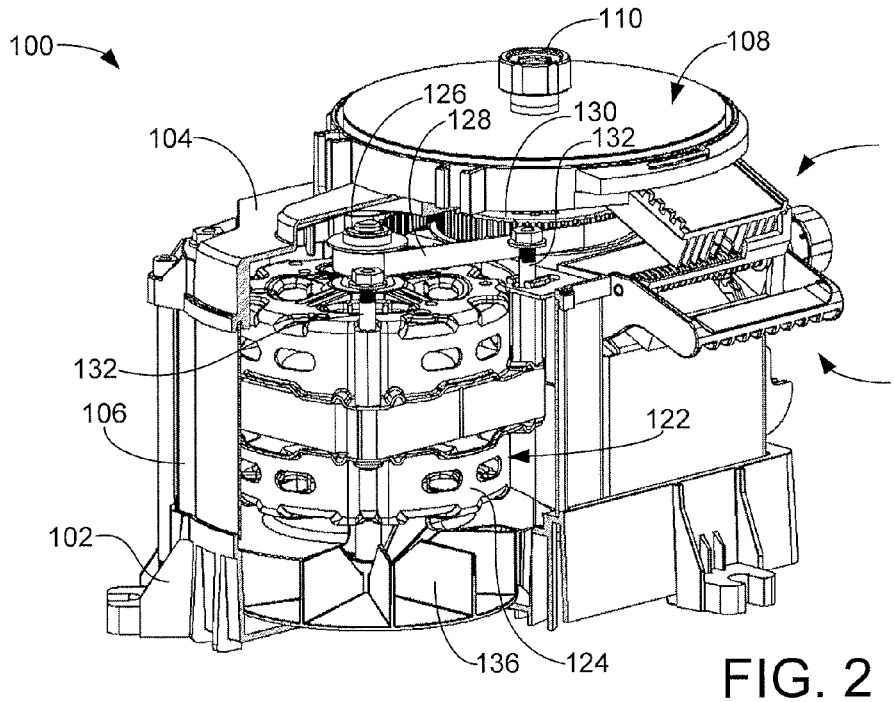
FIG. 2 provides another isometric view of the assembly of FIG. 1 in partial cutaway fashion to reveal selected components of interest including a motor drive assembly.
Figure 3:
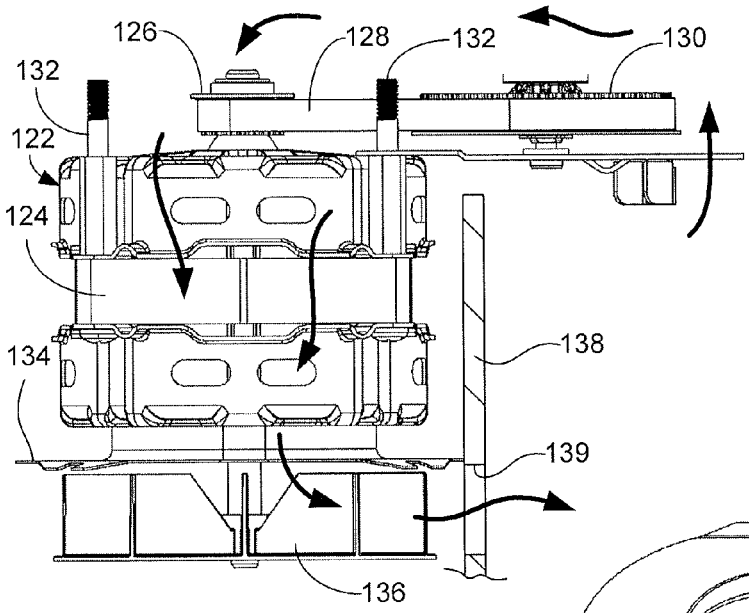
FIG. 3 provides an elevational representation of the motor drive assembly.

FIGS. 2 and 3 show a motor drive assembly 122 used to rotate the disc 108 during operation. The assembly 122 preferably comprises an electric motor 124 which rotates a first gear member 126 at a first, higher speed (such as on the order of about 1750 rpm). A timing belt 128 preferably couples the first gear member 126 to a second gear member 130, which provides suitable gearing reduction and torque adjustment to rotate the disc 108 at the preferred speed of about 580 rpm. The motor 124 is preferably characterized as a 1/5 horsepower, alternating current (AC) induction motor.

Figure 4:
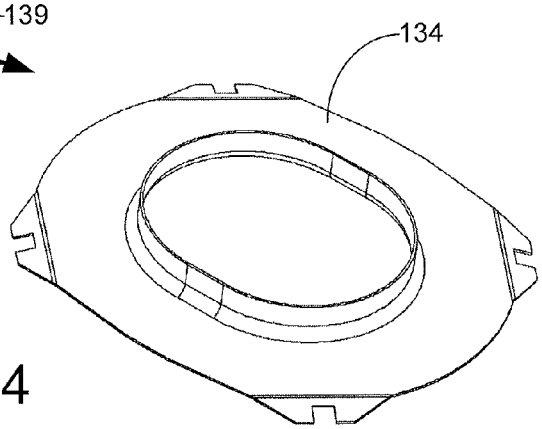
FIG. 4 shows a motor support flange of FIG. 3.

The motor is preferably supported by threaded standoffs 132 which extend through and down from the top member 104 (FIG. 1). The motor 124 is further supported by underlying compliant motor support flange 134 (best shown in FIG. 4). The flange 134 serves as a plenum member for an impeller 136 which is also rotated by the motor 124. As generally represented in FIG. 3, cooling air is preferably drawn from the surrounding atmosphere into the housing adjacent the wedge shaped port 112 to cool the tool, over and down across the motor 124 to cool the motor, past the impeller 136, and out vent apertures 138 through an interior partitioning wall 139 in the base member 102.

Sharpening Using the Wedge-Shaped Port

Figure 5:
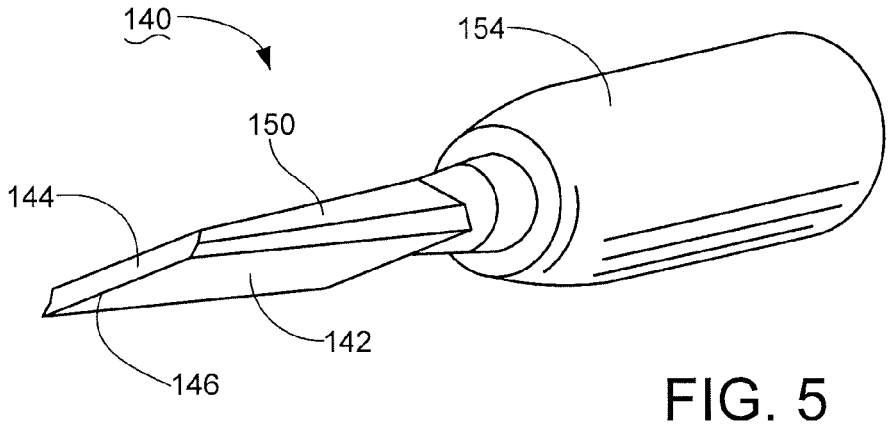
FIG. 5 provides an isometric representation of a tool suitable for sharpening in accordance with preferred embodiments of the present invention.

FIG. 5 provides an isometric representation of a tool 140 suitable for sharpening in accordance with preferred embodiments of the present invention. The tool 140 includes a planar back surface 142 and a beveled leading surface 144 which cooperate to form a laterally extending cutting surface (edge) 146.

Figure 6:
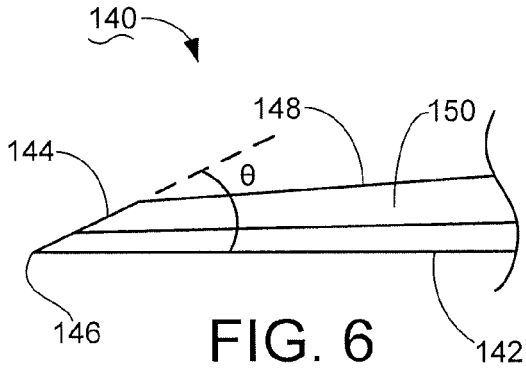
FIGS. 6 and 7 provide respective partial cutaway elevational and top plan views, respectively, of the tool of FIG. 5.
Figure 7:
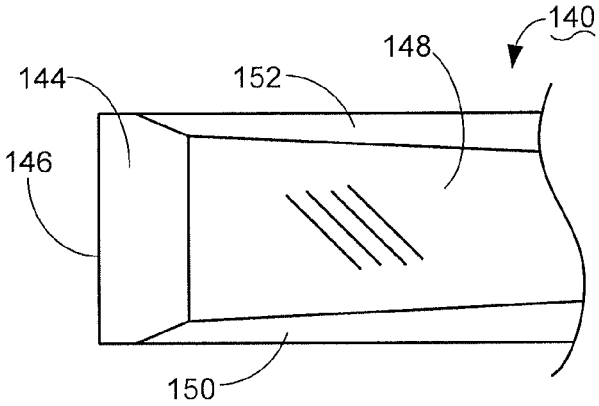

As further shown in FIGS. 6 and 7, the tool 140 also includes an inclined top surface 148, opposing side surfaces 150, 152, and a handle 154. The back surface 142 and bevel surface 144 are disposed at an intermediary angle θ (nominally 25 degrees in the present example) to form the cutting surface 146. As will be recognized by those skilled in the art, the tool 140 can be characterized as a chisel.

Figure 8:
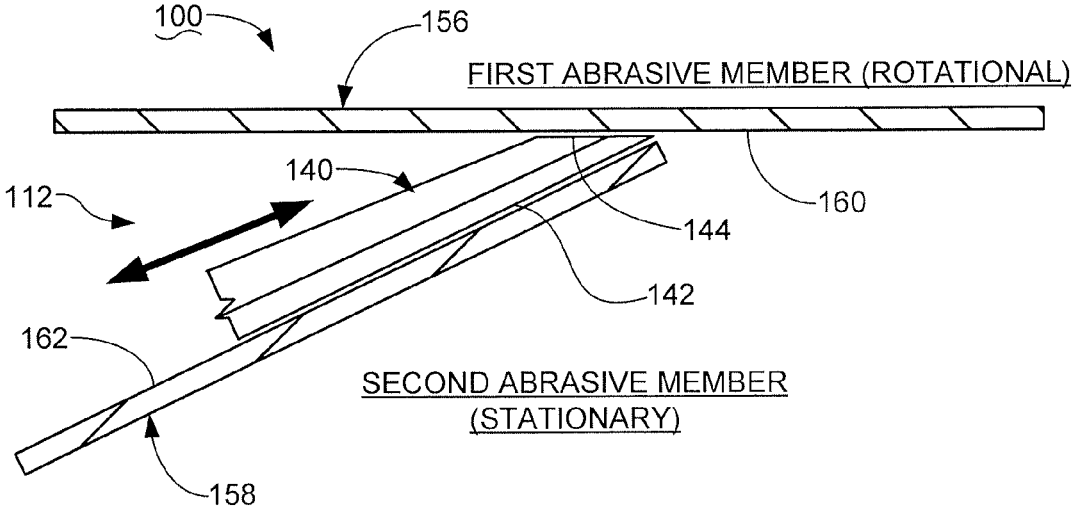
FIG. 8 provides a schematic diagram generally representing preferred orientations of first and second abrasive surfaces of the tool sharpening assembly of FIG. 1 which are utilized in accordance with preferred embodiments to sharpen tools such as the tool of FIG. 5.

FIG. 8 provides a schematic representation of selected portions of the tool sharpening assembly 100 of FIG. 1 associated with the wedge shaped port 112. First and second abrasive members 156, 158 are arrayed at an intervening angle to substantially match the angle θ of the tool 140. The first abrasive member 156 preferably lies along the under surface of the rotatable disc 108, and the second abrasive member 158 is preferably stationary and lies along an inclined ramp surface. Alternatively, the second abrasive member 158 can be powered to reciprocate or otherwise move during operation, as desired.

The members 156, 158 present corresponding first and second abrasive surfaces 160, 162 in facing relation as shown. In a preferred embodiment the first and second abrasive members 156, 158 each comprise coated abrasives or similar removeable and replaceable elements of desired grit levels. Sharpening stones, grinding wheels, sanding belts, etc. can alternatively be utilized as desired.

Generally, during a sharpening operation the tool 140 is preferably inserted into the port 112 so that the back surface 142 is brought into contact with the second abrasive surface 162. Preferably, this insertion is performed manually by user manipulation of the handle 154, although in other embodiments automated manipulation of the tool 140 can be provided using suitable robotic or other mechanisms. A retention member (not shown) such as a spring clip or a magnet can be used as desired to enhance the abutting contact of the back surface 142 against the second abrasive surface 162.

The tool 140 is next advanced so that the back surface 142 slidingly engages the second abrasive surface 162. This provides a honing action upon the back surface 142 so that, depending on the level of abrasiveness of the surface 162 and the state of flatness of the back surface 142, some amount of swarf (grinding debris such as fine chips or shavings) may be removed from the tool 140. A material removal system (not shown) can be provided to remove this swarf, such as through the use of a vacuum port attachment.

The forward advancement of the tool 140 continues until the bevel surface 144 is brought into contact with the moving first abrasive surface 160. Preferably, the tool 140 is held in contact against the first abrasive surface 160 at this point for a relatively short amount of time and with a relatively moderate amount of inwardly directed force. It is contemplated that during this contact a small amount of material will be removed from the distal end of the tool (i.e., the bevel surface 144 will be ground upon by the first abrasive surface).

Figure 9:
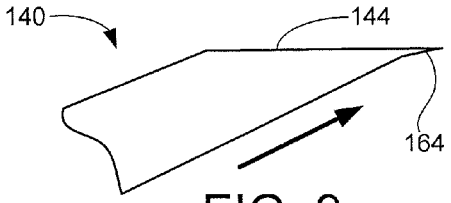
FIG. 9 shows (in exaggerated fashion) a burr formed at a cutting edge of a tool such as the tool of FIG. 5 during operation of the diagram of FIG. 8.

This removed material may be exhibited as swarf, as discussed above. Alternatively or additionally, a small amount of burring (elongation) of material displaced by the first abrasive surface 160 may extend along the cutting edge 146 at this point, as generally represented by burr 164 in FIG. 9.

Figure 10:
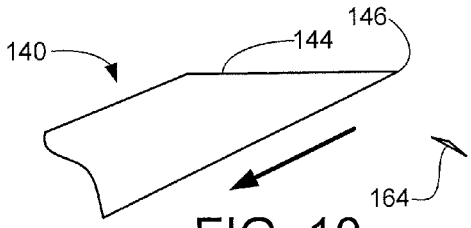
FIG. 10 shows the cutting edge of FIG. 8 upon removal of the burr during operation of the diagram of FIG. 8.

The tool 140 is next retracted by sliding engagement along the second abrasive surface 162, preferably in an opposite direction as before so that the tool 140 is pulled away from the first abrasive member 156. This will again preferably provide a honing action upon the back surface 142 and, additionally, will preferably result in the removal of any such burred material obtained during the previous step, as generally represented in FIG. 10. For reference, the sequential operation of the foregoing insertion, grinding and retraction steps will be referred to herein as a complete "cycle."

Figure 11:
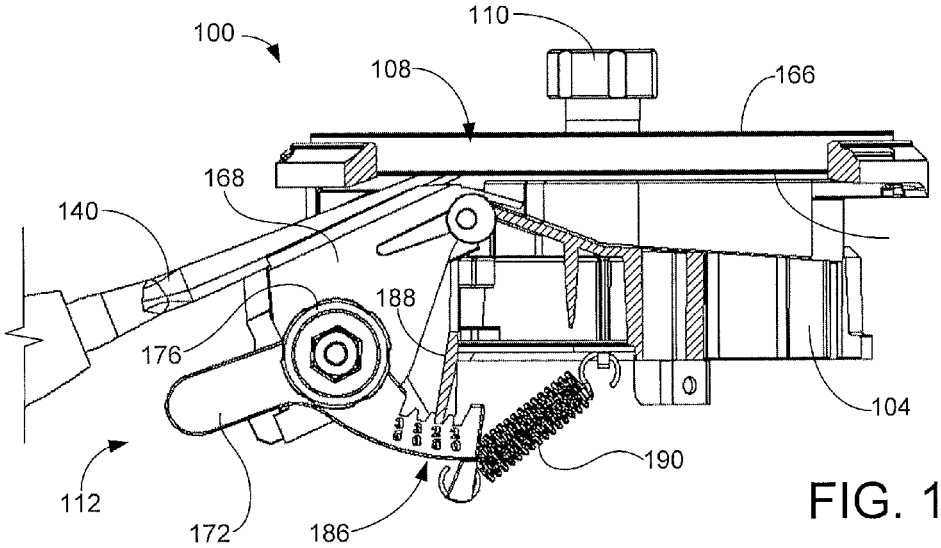
FIG. 11 provides a side-elevational representation of a wedge shaped port of the assembly of FIG. 1.

It is contemplated that in most sharpening operations multiple cycles will be used in immediate succession. The number of cycles will depend on several factors including the original state of the tool 140, but an exemplary number may be on the order of 5-20 cycles. It may be preferable to first "flatten the back" of the tool 140 prior to these sharpening cycles by placing the back surface 142 of the tool 140 onto a third abrasive member 166 on the top surface of the rotating disc 108 (FIG. 11). This initial honing generates a flat reference surface to ensure proper intersection of the second abrasive surface with the cutting edge.

Depending on the quality of the steel or other material of which the tool 140 is formed, as well as the respective grit levels of the various abrasive surfaces, levels of sharpness approaching "razor" or so-called "scary" sharpness can be readily and repeatably obtained. Any number of different grit sequences can be applied; in a preferred embodiment, the first abrasive member 156 has a grit on the order of 80-100, the second abrasive member 158 has a grit of 200-400, and a third abrasive member on the top surface of the disc 108 (shown at 166 in FIG. 11) has a grit of 800-1200. Other values, of course, can be used as desired.

In another preferred embodiment, multiple discs similar to 108 are provided with opposing surface grits that step up from progressively coarser to finer levels (e.g., 80, 220, 400, 1200, etc.). An initially dull or damaged tool is subjected to the coarsest grit to achieve an initial sharpening. The discs are then turned over and/or replaced to provide a sequence of increasingly finer grits against which the bevel surface 144 is ground during subsequent cycles. In this way, substantially any tool can be brought to "razor" like sharpness in a matter of a few minutes.

An advantage of this sharpening methodology is that during any particular cycle, the amount of material that is removed and/or displaced in the form of a distally extending burr will usually tend to be relatively small, particularly as compared to various prior art approaches. A burr such as 164 obtained from the contact of the bevel surface 144 with the first abrasive member 156 will often be relatively small and stiff, facilitating easy removal during the subsequent retraction of the tool 140. This advantageously prevents or reduces the propensity for a relatively large burr of material to accumulate on the tool, which would require more aggressive removal efforts and less than optimal sharpening results.

FIGS. 11-19 illustrate various aspects of the sharpening port 112 in greater detail. Major components include a support base 168, heat sink assembly 170, bevel angle selection lever 172, fence assembly 174, worm gear assembly 176, and skew adjustment member 178.

Figure 12:
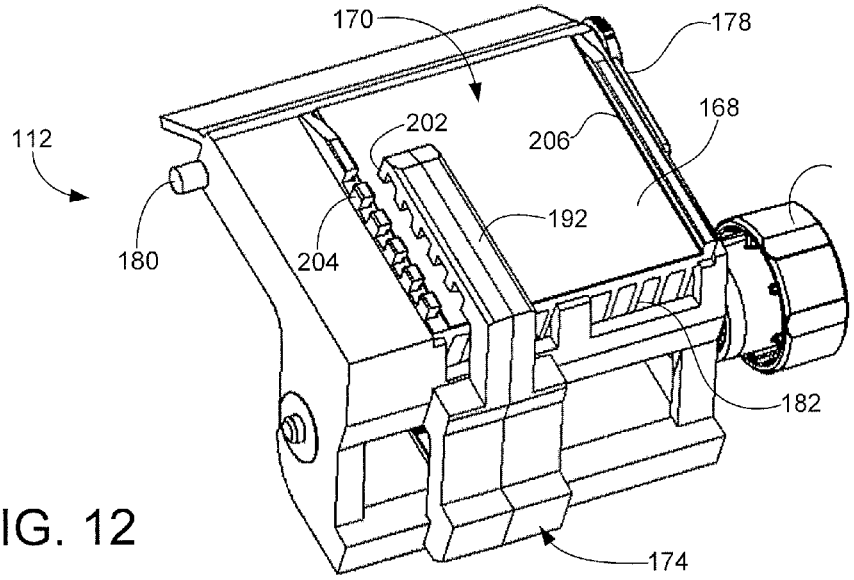
FIG. 12 provides another view of the wedge shaped port.
Figure 13:
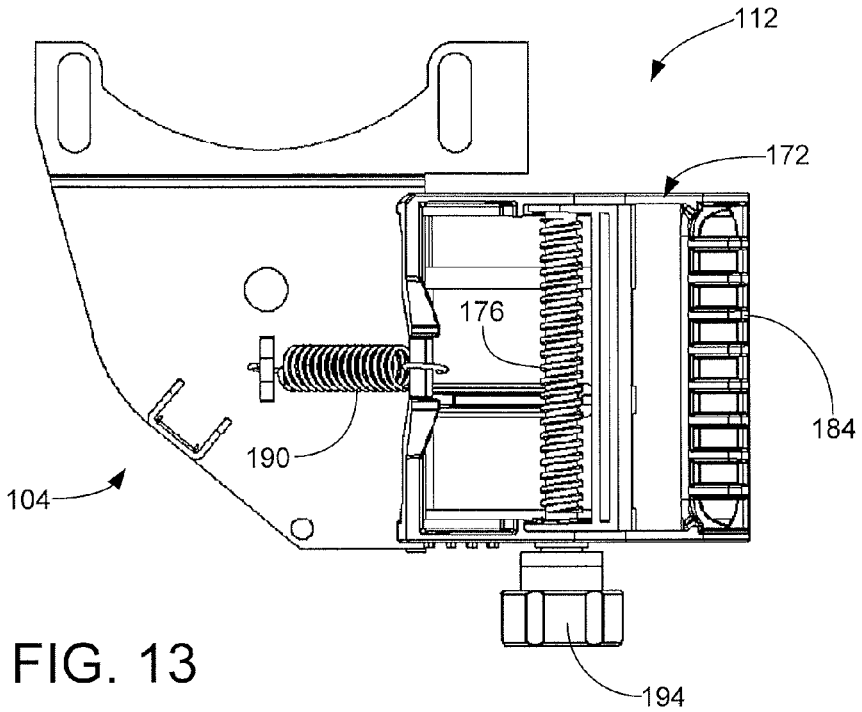
FIG. 13 shows another view of the wedge shaped port.
Figure 14:
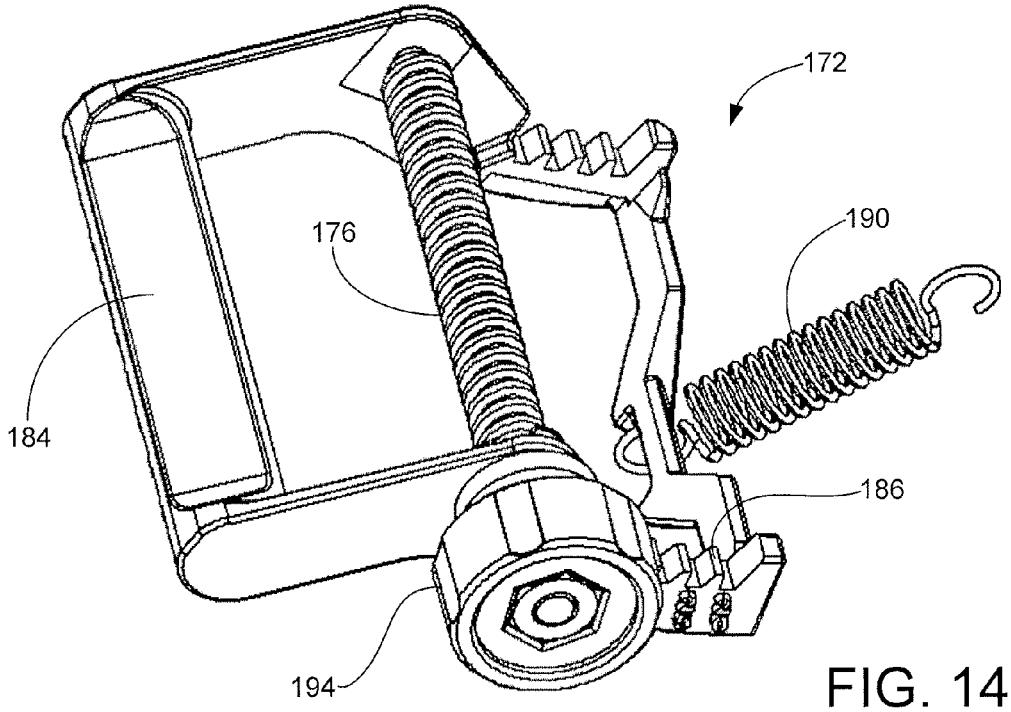
FIG. 14 illustrates a spring bar mechanism of the wedge shaped port.

The support base 168 is best viewed in FIG. 12 and is pivotally attached to the top member 104 via pin 180 and the skew adjustment member 178. The support base 168 supports the heat sink assembly 170 (see FIG. 20) at the desired presentation angle for the tool 140. The heat sink assembly 170 preferably includes an inclined ramp structure that supports the aforementioned second abrasive member 158 along a top side thereof, and includes a number of cooling fins 182 which extend downwardly as shown.

In some preferred embodiments, the second abrasive member 158 is an adhesive sheet of sandpaper or similar abrasive material which is adhered to the heat sink assembly 170. In alternative preferred embodiments, the second abrasive member 158 comprises a diamond coating or similar hardened texturing that is supplied to the top surface of the heat sink.

In the exemplary environment of the tool sharpening assembly 100, the bevel angle for the port 112 is preferably adjustable. More specifically, the bevel angle selection lever 172 includes a user actuated handle 184 (FIG. 14) which can be raised by the user to selectively engage a number of engagement teeth 186 with a corresponding flange 188 (FIG. 11) of the top member 104. A spring 190 preferably biases the lever 172 in the selected position. Adjustable bevel angles of 15, 20, 25 and 30 degrees are shown, although other adjustment angles can be selected as desired. Alternatively, the port 112 can be configured to provide continuously adjustable bevel angles, or no adjustments at all (e.g., a fixed bevel angle of 25 degrees, etc.).

Figure 15:
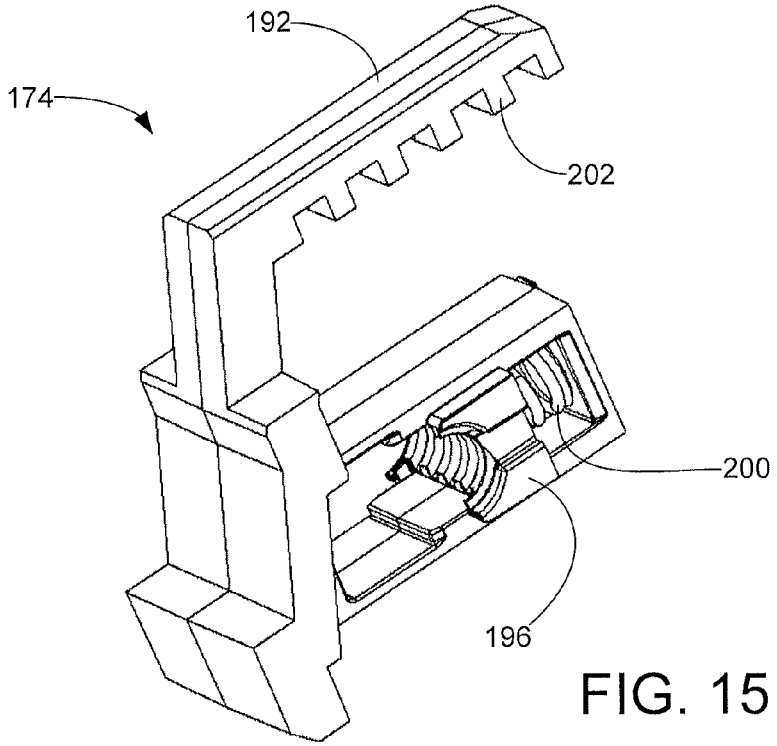
FIG. 15 shows an adjustable fence assembly of the wedge shaped port.
Figure 16:
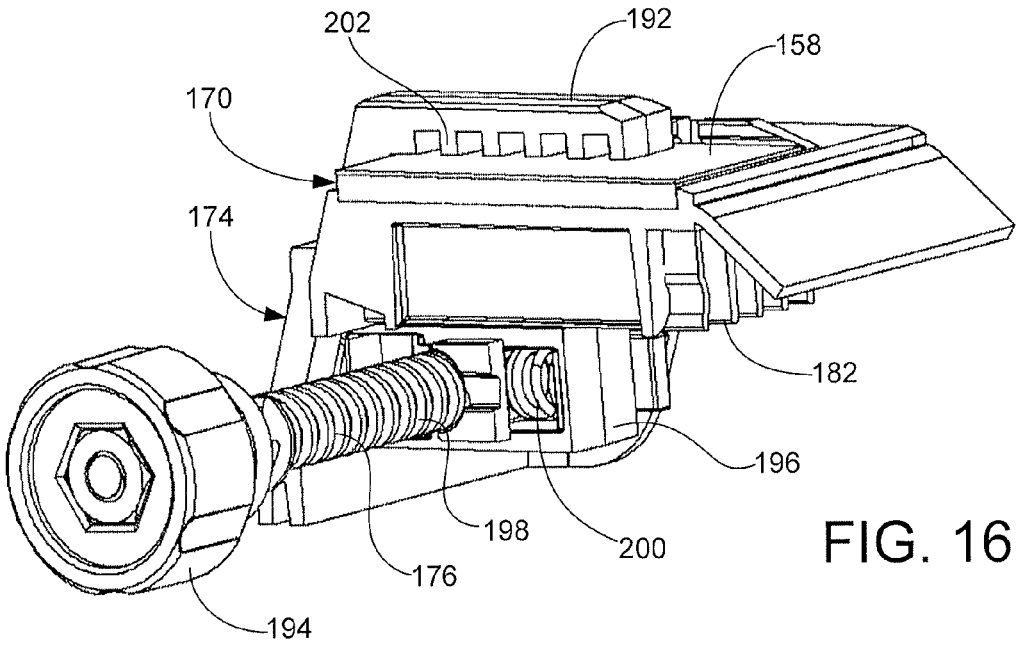
FIG. 16 is a partial cutaway to show a preferred interaction between the members of FIGS. 14 and 15.

The fence assembly 174 is substantially u-shaped with a cantilevered alignment arm 192 which extends adjacent the abrasive member 158 of the heat sink assembly 170. The arm 192 preferably serves as a guide surface to support a side of the tool 140 during the aforedescribed sharpening cycles. The arm 192 is laterally moved across the surface of member 158 through user activation of a knob 194 of the worm gear assembly 176. More specifically, as shown in FIGS. 15 and 16, the fence assembly 174 includes a threaded member 196 which is biased against a threaded shaft 198 of the worm gear assembly 176 via internal spring 200. Rotation of the shaft 198 results in lateral displacement of the fence assembly 174 to align the arm 192 to the desired location.

The arm 192 is preferably shown to include a number of downwardly projecting teeth 202 which pass between corresponding upwardly projecting teeth 204 of the heat sink assembly 170. In this way, the arm 192 can be advanced wholly beyond the abrasive surface 158 when, for example, a tool is presented for sharpening that has a width substantially equal to the width of the abrasive surface 158 (preferably on the order of about 2½ inches).

When the arm 192 is in use, the user has the option of placing the tool 140 to either the right or the left of the arm 192, as desired. When the tool 140 is to the left of the arm 192, the user can utilize the arm 192 and the base support teeth 204 to form opposing guide surfaces during the longitudinally directed honing action of the tool 140 against the abrasive member 158. Conversely, when the tool 140 is to the right of the arm 192, the user can utilize the arm 192 and a guide surface 206 of the support base 168.

It is recommended that tools of relatively smaller width (e.g., 1 inch or less in width) are preferably sharpened to the left of the fence assembly 174 (an "inboard position"), and tools of relatively larger width (e.g., greater than 1 inch in width) are preferably sharpened to the right of the fence assembly 174 (an "outboard position). This is because the instantaneous linear velocity of the disc 108 at the point of contact for the tool will generally be lower at the inboard position as compared to the outboard position, so that greater heating of the tool may be experienced at the outboard position as compared to the inboard position. Grinding a smaller tool (with smaller overall mass) at the inboard position thus advantageously reduces a likelihood that the tool will overheat and suffer annealing (undesired recrystalization of the tool member) or other damage.

Figure 17:
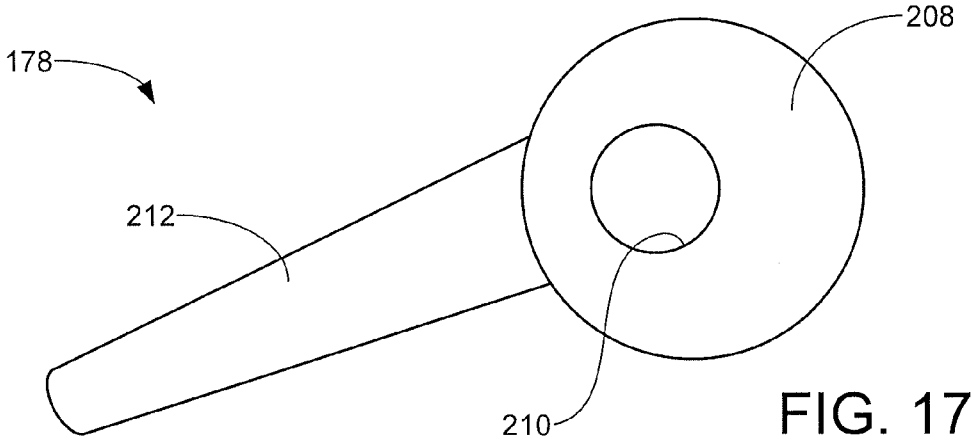
FIG. 17 is a skew adjustment member of the wedge shaped port.
Figure 18:
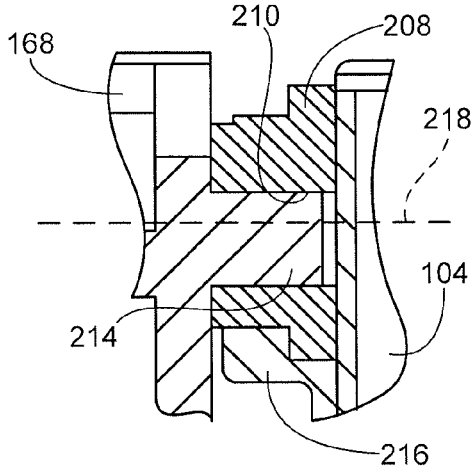
FIGS. 18 and 19 generally illustrate a preferred manner in which the member of FIG. 17 operates to adjust skew of the wedge shaped port.
Figure 19:
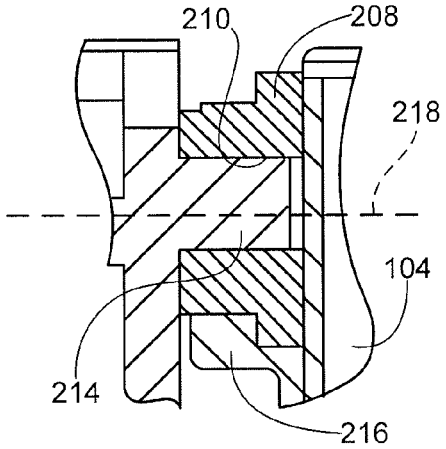

The skew adjustment member 178 generally operates to allow the user to adjust skew, or lateral (left-to-right) leveling, of the base support 168. As shown in FIGS. 17-19, the skew adjustment member 178 preferably comprises an annular body portion 208, an engagement through aperture 210, and a user activated lever 212.

A pin 214 extends from the support base 168 opposite the pin 180 (see FIG. 12). The aperture 210 of the skew adjustment member 178 receivingly engages this pin 214 as shown. The body portion 208 of the skew adjustment member 178 is supported by a support flange 216 of the top member 104. The body portion 208 rotates about the pin 214 as the user raises or lowers the handle 212.

The aperture 210 is offset from the center of the body portion 208 by a relatively small distance (e.g., 0.050 inches). This eccentricity induces relative up or down movement of the right side support base 168 as the handle is raised or lowered.

More particularly, as shown by FIGS. 18 and 19, a reference line 218 is axially aligned with the support post 180 on the opposite side of the support base 168 (see FIG. 12). The overall vertical distance between the line 218 and the support flange 216 remains constant; however, as the skew member 178 is rotated, a greater or lesser thickness of the body portion 208 is provided between these points, thereby elevating or lowering the pin 214. Movement of the pin 214 relative to the pin 180 sets the skew of the port 112 to the desired level.

Figure 20:
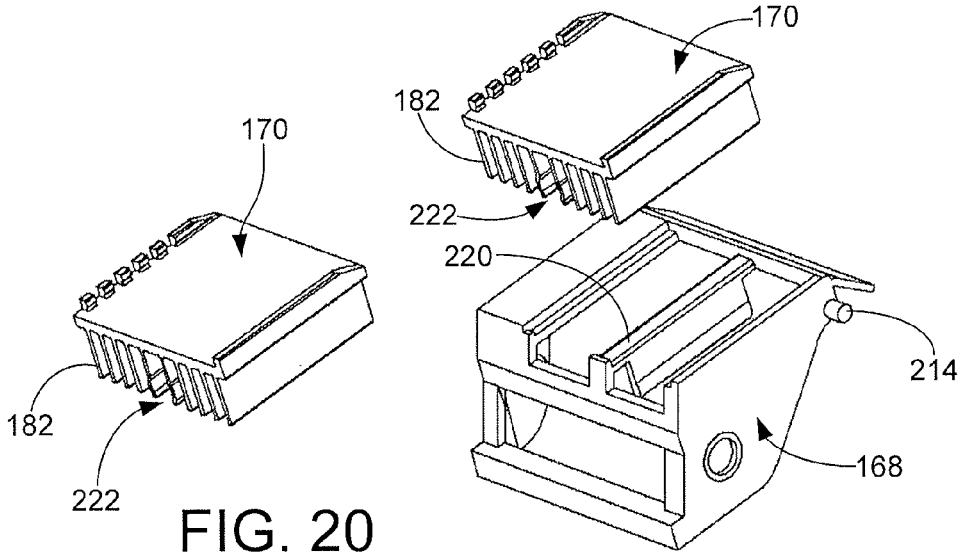
FIG. 20 generally illustrates a preferred heat sink assembly attachment methodology of the port.

FIG. 20 shows a preferred attachment of the heat sink assembly 170 to the support base 168. The support base 168 is provided with a centrally disposed retention flange 220 which is engaged by opposing spring clips 222 of the heat sink assembly 170. In a preferred embodiment, multiple heat sink assemblies 170 with different grits are provided and selectively installed and removed as desired, such as generally illustrated in FIG. 20. As noted above, the heat sink assembly 170 can alternatively be permanently affixed to or otherwise incorporated as part of the support base 168.

Figure 21:
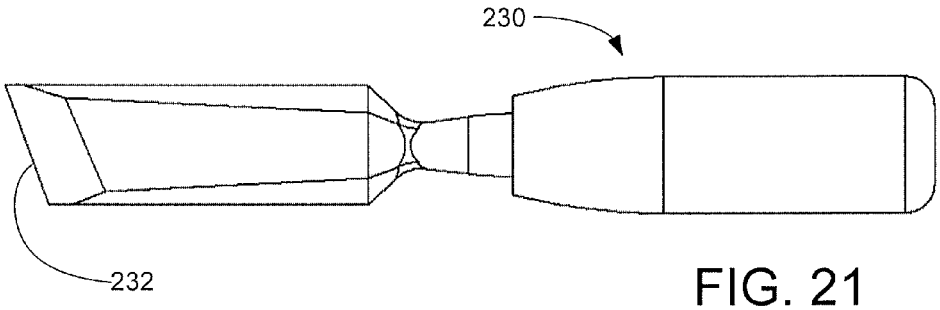
FIG. 21 shows another tool generally similar to the tool of FIG. 5, with the tool of FIG. 21 preferably characterized as an angled chisel.

FIG. 21 generally illustrates another cutting tool 230, preferably characterized as an angled chisel. The tool 230 is generally similar to the chisel 140 of FIG. 5, except that the angled chisel 230 has a linearly extending cutting surface 232 that is skewed with respect to a longitudinal axis of the chisel. The angle of the cutting surface 232 can vary for different tools of this class, but a typical angle can be on the order of about 25 degrees.

Figure 22:
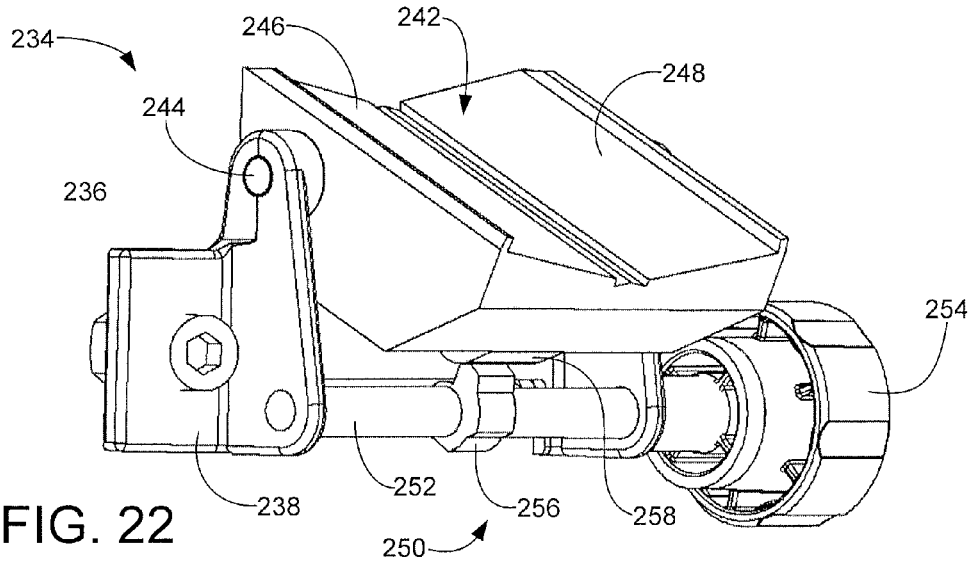
FIGS. 22 and 23 provide respective front and back elevational views of a tool support assembly useful in sharpening tools such as shown in FIG. 21.
Figure 23:
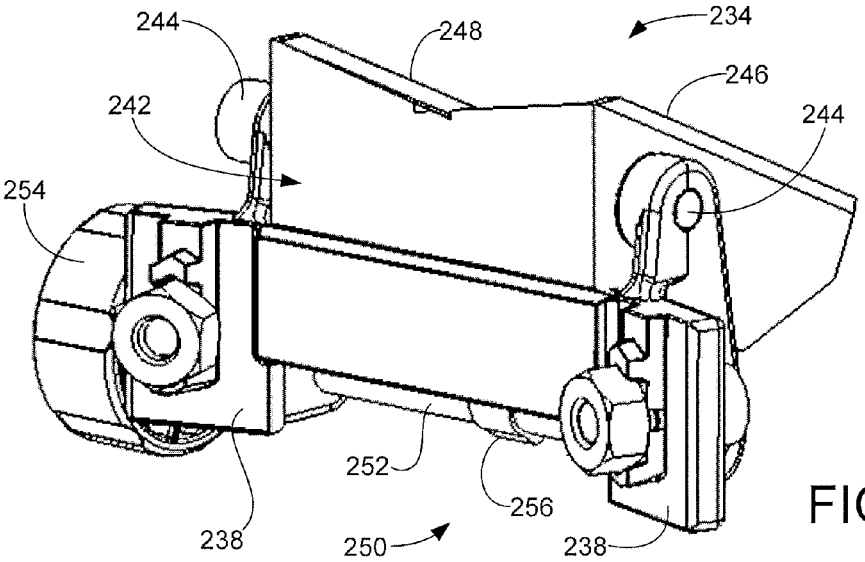

It can be seen that the wedge-shaped port 112 can be used to sharpen tools such as 230, so long as the tool 230 is presented by the user at an angle such that the cutting surface 232 is substantially aligned with the disc 108. However, in a preferred embodiment such tools are sharpened using an angled tool support assembly 234 as shown in FIG. 22.

Figure 24:
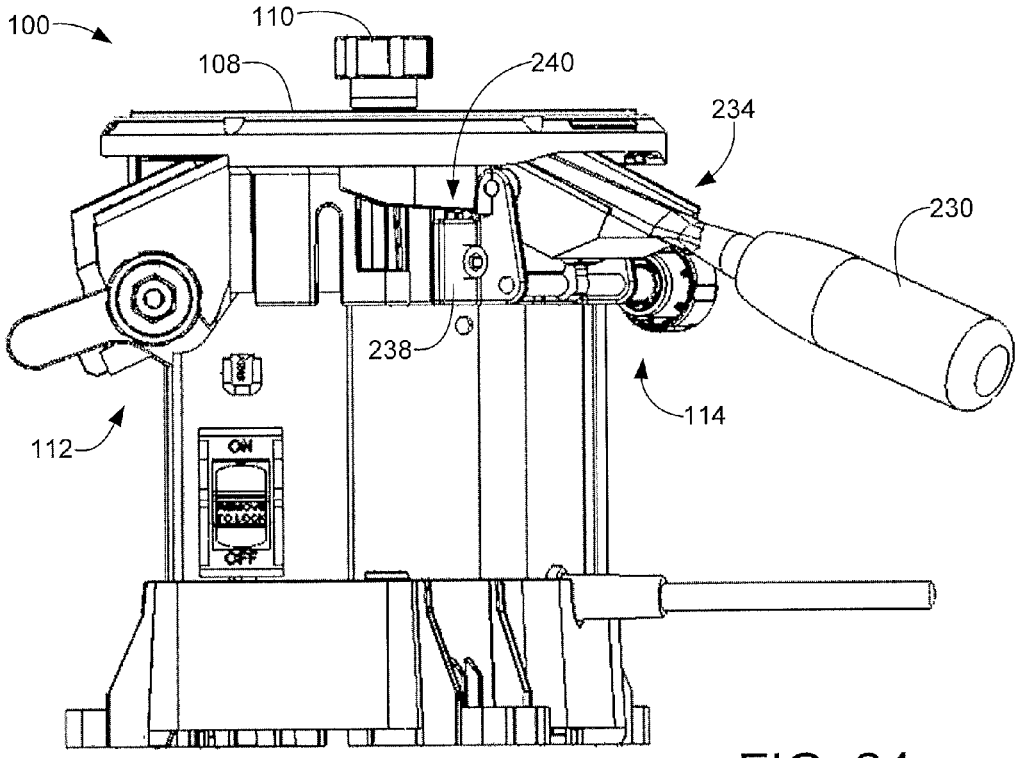
FIG. 24 provides an isometric elevational view of the tool sharpening assembly 100 in conjunction with the assembly of FIGS. 22-23.

The angled tool support assembly 234 preferably comprises a base 236 with engagement legs 238. The legs 238 engage a corresponding pair oft-slots 240 of the tool support assembly 100 in the area proximate the sharpening port 114, as shown in FIG. 24. A generally v-shaped tool support member 242 is mounted to the base 236 via pivot pins 244. The tool support member 234 preferably includes opposing angled tool support surfaces 246, 248. These surfaces are preferably abrasive surfaces, as before, such as through the application of respective abrasive layers with adhesive backing, or through diamond texturing or similar processing.

An angular adjustment assembly 250 is also affixed to the base 236, and operates to adjust an elevational (front-to-back) angle of the tool support member 234. A central shaft 252 is rotated by a user activated knob 254 to bring a cam 256 into displacing contact with a corresponding camming surface 258 of the support member 242. Thus, as the knob 254 is rotated, the front-to-back elevational orientation of the surfaces 246, 248 is controllably adjusted to match a suitable angle for the tool 230. A biasing member (not shown) is preferably used to apply an adequate biasing force upon the tool support member 242 so that the camming surface 258 remains urged against the cam 256.

Figure 25:
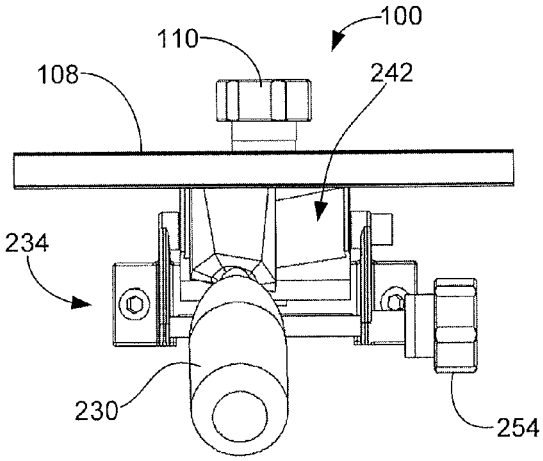
FIG. 25 shows a preferred alignment for sharpening tools such as shown in FIG. 21 with a cutting surface that angles down to the left.

The tool support assembly 234 thus provides another wedge-shaped sharpening port similar to the sharpening port 112. If the angle of the cutting surface 232 of the tool 230 slopes down to the left (as depicted in FIG. 21), the tool 230 can be sharpened by placement of the tool against the left-side abrasive surface 246, as generally depicted in FIG. 25. Contrawise, if the angle of the cutting surface of the tool slopes down in the opposite direction (to the right), the tool can be sharpened using the right-side abrasive surface 248, as shown in FIG. 26.

Figure 26:
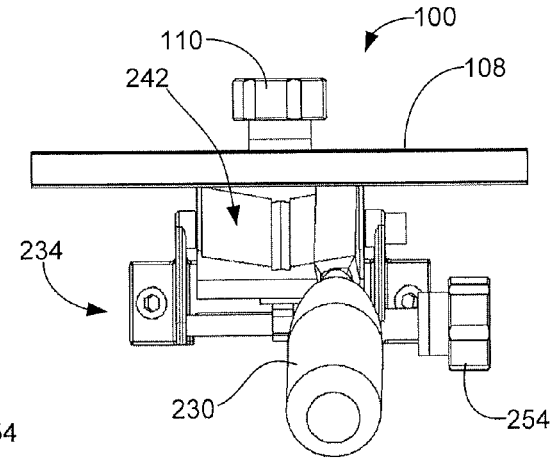
FIG. 26 shows a corresponding preferred alignment for sharpening tools such as shown in FIG. 21 with a cutting surface that angles down to the right.

For both FIGS. 25 and 26, it will be appreciated that the tool 230 is preferably sharpened by honing the back plane against the underlying abrasive surface while bringing the distal cutting surface and beveled edge into intermittent contact with the rotating underlying abrasive surface of the disc 108.

Figure 27:
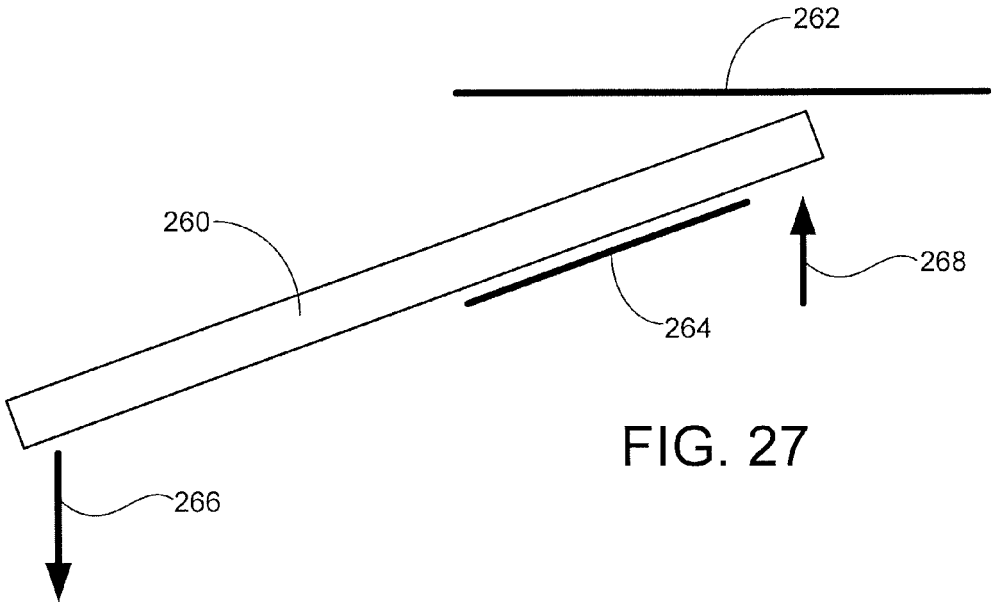
FIG. 27 is a schematic force diagram for the wedge shaped sharpening ports.

FIG. 27 provides a schematic depiction of the wedge port sharpening described above for either port 112 or port 114. A generic tool is depicted at 260, the first abrasive surface is depicted at 262, and the second abrasive surface is depicted at 264.

It is contemplated that in most cases the center of gravity for the tool 260 will likely be located near or beyond the outermost edge of the second abrasive surface 262. When the sharpener 100 is generally oriented as shown in FIG. 1, gravity will generally tend to aid in the sharpening process by urging the cutting surface of the tool 260 toward the first abrasive surface 262.

More particularly, the downwardly directed force upon the distal end of the tool 260, represented by arrow 266, will generally urge the proximal end of the tool into contact with the first abrasive surface 262, as indicated by force arrow 268. The user can thus easily support the tool 260 by its handle and apply a relatively light upward force during the sharpening process to overcome the effects of gravity. This has been generally found to be a natural and easily controlled manipulation for most users.

Figure 28:
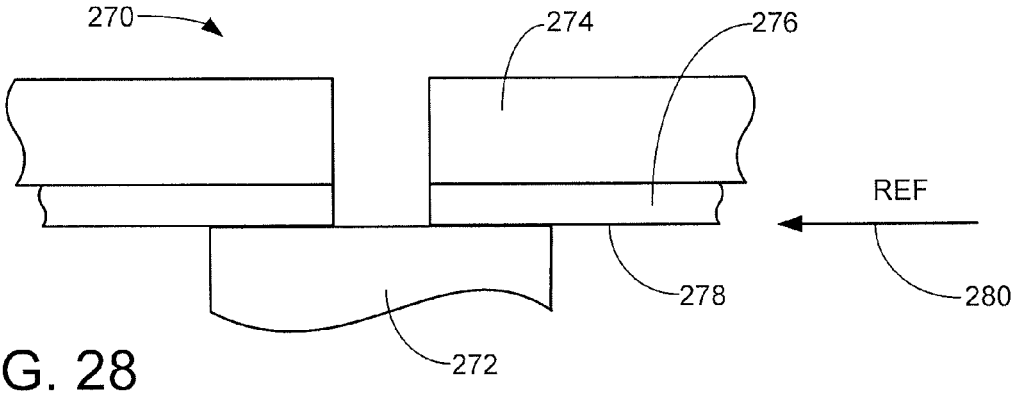
FIGS. 28 and 29 show respective abrasive discs of different thicknesses mounted to the sharpener 100.
Figure 29:
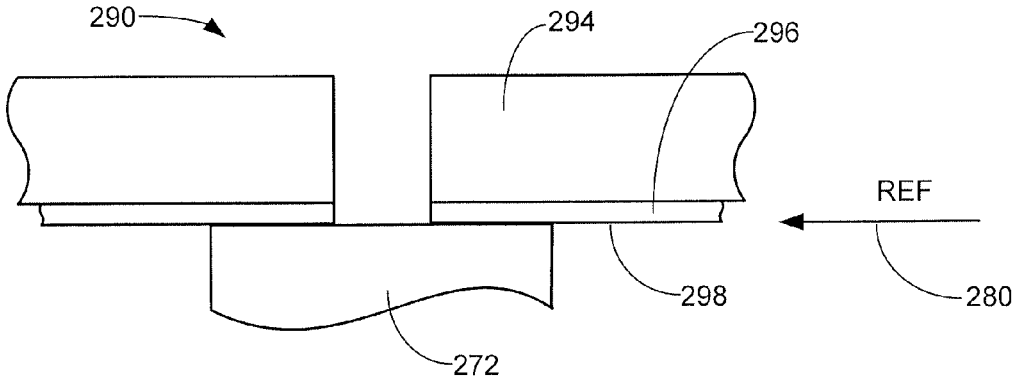

Another advantage of underside grinding as generally set forth by the sharpening at ports 112, 114 can be appreciated from a review of FIGS. 28 and 29. FIG. 28 shows a first disc 270 supported by a spindle support 272. The first disc 270 includes a substrate 274 and a relatively thick abrasive sheet 276 with a first abrasive surface 278. A preferred mounting arrangement used by the sharpener 100 locates the abrasive surface 278 directly onto the spindle support 272 at a fixed reference elevation 280.

FIG. 29 provides a second disc 290 which is alternatively supported by the spindle support 272 in place of the first disc 270. The second disc 290 also includes a substrate 294, and has a relatively thin abrasive sheet 296 with first abrasive surface 298. As in FIG. 28, the abrasive surface 298 in FIG. 29 is also preferably directly mounted onto the spindle support 272 at the fixed reference elevation 280.

From these figures it will be noted that irrespective of the overall thicknesses of the respective discs 270 and 290, and irrespective of particular variations between thicknesses of the sheets of coated adhesive 276 and 296, the elevation at which the underlying abrasive surfaces 278, 298 will preferably in all cases be nominally the same (i.e., at reference elevation 280). This ensures that the geometries established by the sharpening port will not be substantially changed with respect to the location of the first abrasive surface, which can be particularly advantageous when different grits of abrasive are sequentially used during the sharpening operation.

Figure 30:
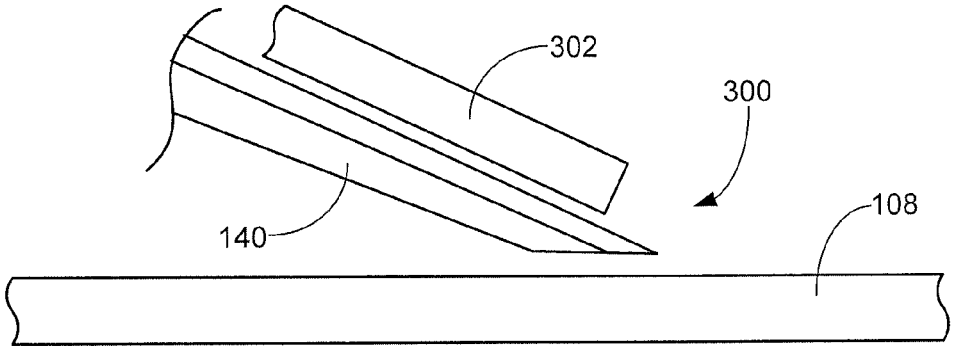
FIG. 30 generally represents a wedge shaped port sharpening methodology utilizing a top surface of the rotatable disc.
Figure 31:
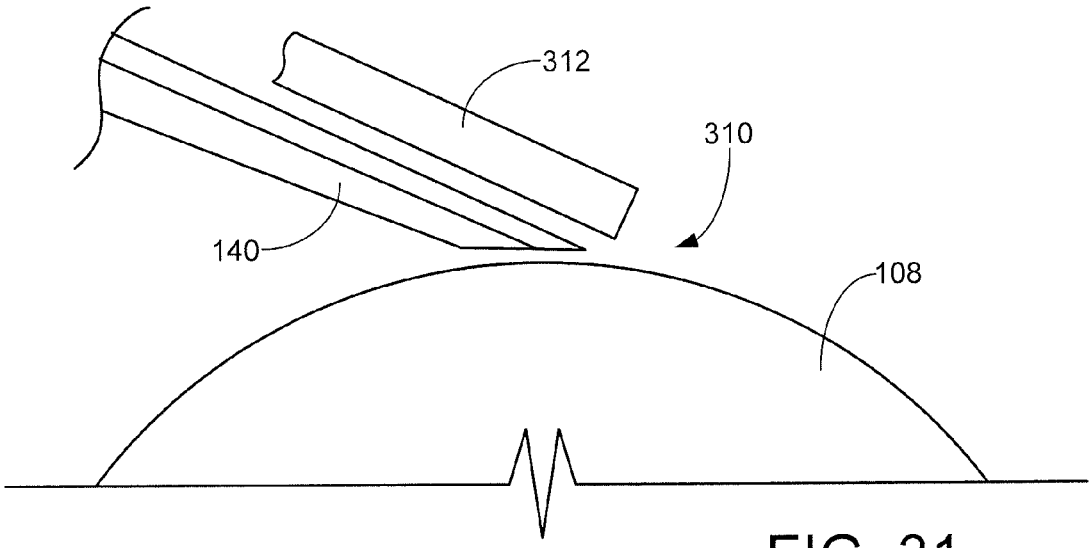
FIG. 31 generally represents another wedge shaped port sharpening methodology utilizing an edge of the rotatable disc.

The wedge shaped port sharpening discussed herein is not necessarily limited to underside grinding. As shown in FIG. 30, a wedge shaped port 300 can be readily formed above the disc 108 using a second abrasive member 302 oriented as shown. As shown in FIG. 31, another wedge shaped port 310 can be formed using a circumferentially extending edge of the disc 108 and a second abrasive member 312 oriented substantially as shown.

Sharpening operations using the respective ports 300, 310 are preferably carried out as described above. It will be noted that, depending on the relative orientations of the ports 300, 310, the respective gravitational force vectors may be the same as, or different from, the orientations discussed in FIG. 27.

It will be now appreciated that the various alternative wedge shaped port sharpening operations set forth above provide a number of advantages over prior art sharpening techniques. The wedge shaped port provides superior sharpening results in a fast and easily controlled manner. The sharpening forces on the bevel portion of the tool are opposed by the second abrasive surface, which enhances the ability to control presentation of the tool against the first abrasive surface.

The cyclical presentation of the tool against the respective first and second abrasive surfaces generally operates to provide reduced burr generation, and what burrs are generated are easily removed during the honing strokes. The bevel angle is set simply by the relative angle between the first and second abrasive surfaces, and is not substantially affected by variations in either abrasive layer or disc thickness, leading to increased repeatability.

Another particularly useful advantage is the elimination of the need to attach clamps or other fixturing to each tool to be sharpened; the sharpener 100 itself provides the guide surfaces to allow the user to insert and sharpen each tool. Indeed, once the bevel angle, fence location and skew alignment are set, this same setup can easily be used to handle the sharpening of multiple tools in quick succession.

Finally, the sharpener 100 is preferably configured as described herein so that the various ports can be positioned in a user friendly and ergonomic position. The tool can be held and manipulated in a way that is comfortable and easily controlled by the user. And at least with regard to the underside grinding of ports 112 and 114, gravity helps guide the cutting edge into the port and against the first abrasive surface.

Active Cooling of the Tool

Those skilled in the art will generally recognize the importance of controlling the amount of heat generated by and accumulated in a tool during sharpening. The interaction between a tool and an abrasive surface can generate significant amounts of heat that, if not adequately controlled, can lead to overheating and irreparable damage to the tool material.

There have been a number of approaches developed in the art to address this problem. Some prior art approaches utilize liquid or flood type coolant systems to bathe the tool and/or the abrasive surface during the sharpening operation. Such approaches are sometimes referred to as "wet sharpening." While such approaches have been found generally operable in reducing overheating, many users find the setup time, maintenance and cleanup required to be undesirable.

Other prior art approaches do not incorporate a liquid coolant, but instead rely on slow material removal rates and operator skill to limit overheating of the tool. These prior "dry" systems do not employ any means of removing excess heat from the tool other than the inherent losses do to natural convection and absorption.

By contrast, preferred embodiments of the present invention generally provide active cooling of the tool. The temperature of the tool is actively regulated without the use of a liquid coolant applied to either the abrasive or the tool. The previously discussed sharpening cycle further limit the amount of frictional heating by providing intermittent contact with the first abrasive surface. Additionally, the speed reduction employed in the motor drive assembly 122 limits the frictional heat generated.

Figure 32:
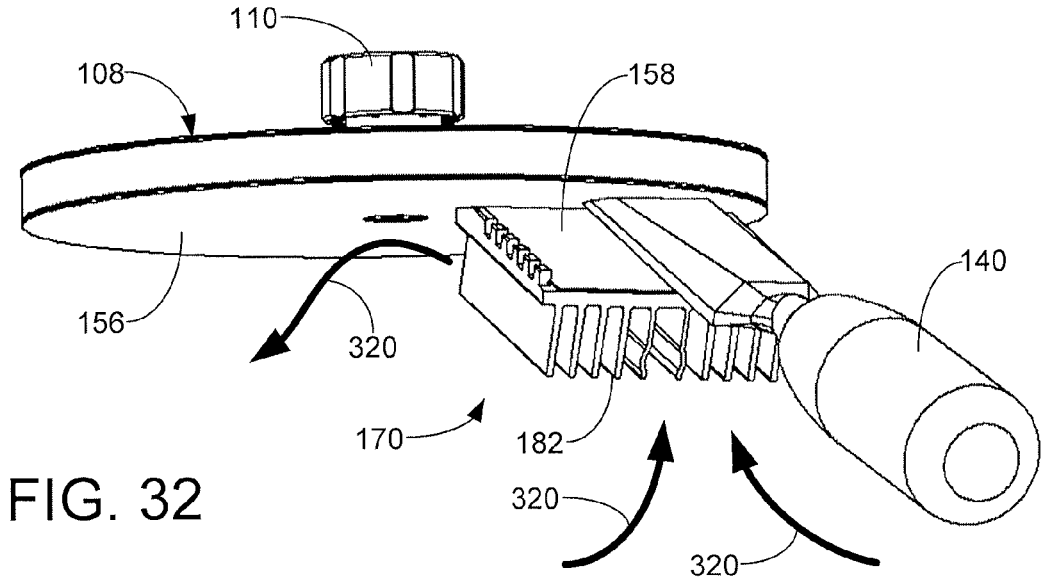
FIG. 32 shows a heat sink member of the wedge shaped port which actively removes heat from the tool in accordance with a preferred embodiment.

As shown in FIG. 32, a cooling fluid in the form of ambient air (arrows 320) is preferably drawn into the housing and passes adjacent the heat sink assembly 170, which serves as a tool support. Heat generated by the sharpening process is thus transferred from the tool 140 to the heat sink assembly 170, and then from the heat sink assembly 170 to the cooling fluid 220 via fins 182. Preferably, the warmed fluid 220 is directed through the assembly 100 as previously depicted in FIG. 3.

It will be noted that the heat transfer path in this case passes through the abrasive member 158 of the heat sink assembly 170. When the abrasive surface 158 is characterized as a layer of coated abrasive, it will be appreciated that the coated abrasive will preferably comprise relatively thin layers of adhesive, backing (fibers, film, etc.), abrasive, and a bonding agent. It will be recognized that each layer may conduct heat at a different rate (thermal conductivity) than the heat sink material. Examples of various materials and exemplary corresponding thermal conductivity (W/m ° K) used in these layers include: aluminum (250), silicon carbide (120), aluminum oxide (35), zirconium oxide (2), paper (0.05), polyethylene (0.5), common adhesives (3).

It will further be recognized that common abrasives can exceed the thermal conductivity of carbon steel (54) from which the tool is generally constructed. It has been found that the relative thickness of each of these materials can be adjusted to provide a sufficient rate to conduct heat away from the tool and prevent overheating and damage.

On the other hand, if the abrasive surface is texturized and/or forms a portion of the underlying heat sink material, thermal conductivity can be increased significantly. Diamond is the preferred abrasive for high heat with a thermal conductivity up to 5 times higher that copper at 2000 W/m ° K.

Figure 33:
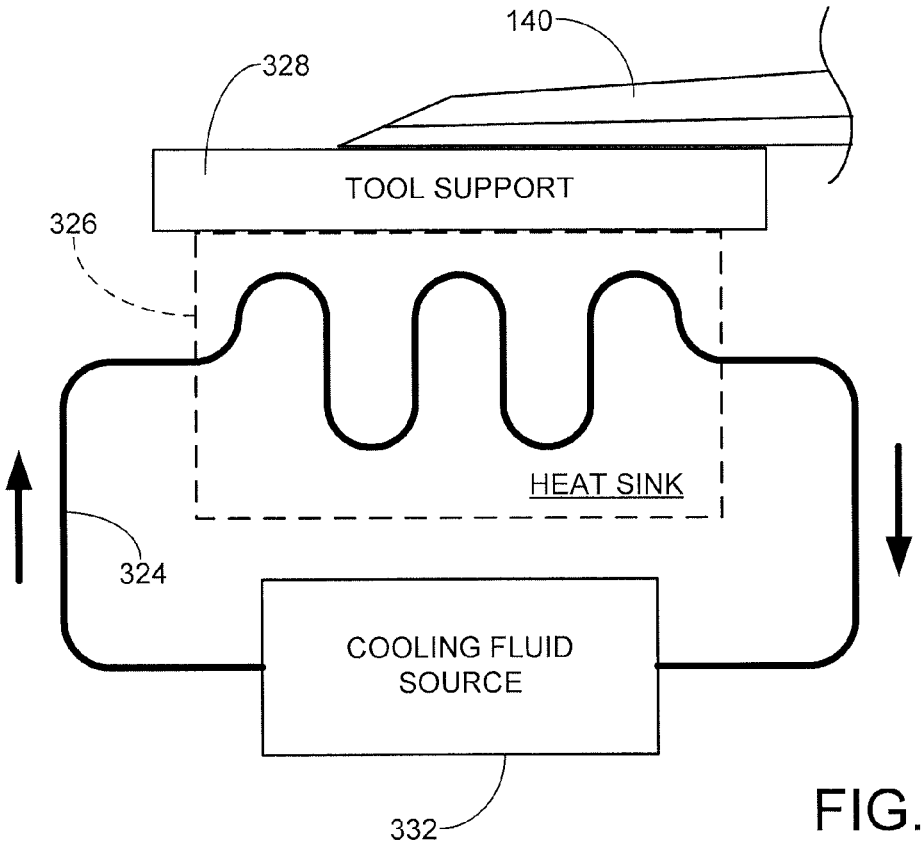
FIG. 33 shows an alternative embodiment in which a heat exchanger uses a cooling fluid to actively remove heat from the tool.

In an alternative preferred embodiment, as shown in FIG. 33 a cooling fluid such as a gas or liquid (e.g., water, compressed refrigerant, etc.) is provided from a source 322 along a closed conduit path 324 to a heat exchanger 326. Coils or other circuitous paths for the cooling fluid can be provided as shown within the heat exchanger as desired.

As before, heat generated by the sharpening process is transferred from the tool 140 to a generalized tool support structure 328 (e.g., the heat sink assembly 170) and then to the exchanger 326 so that the cooling fluid serves to sink the generated heat. Although not shown, it will be appreciated that in further preferred embodiments the warmed fluid exiting the exchanger 326 can be cooled by the source 322. While the tool support structure 328 preferably comprises an abrasive surface, such is not necessarily required.

Figure 34:
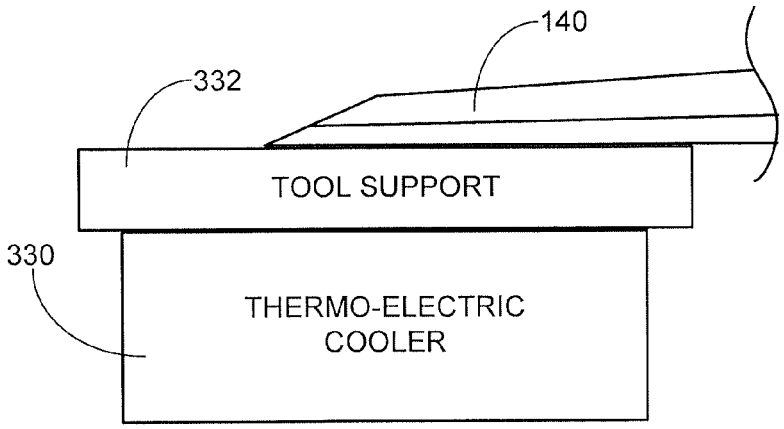
FIG. 34 shows another alternative embodiment in which a thermo-electric cooler mechanism actively removes heat from the tool.
Figure 35:
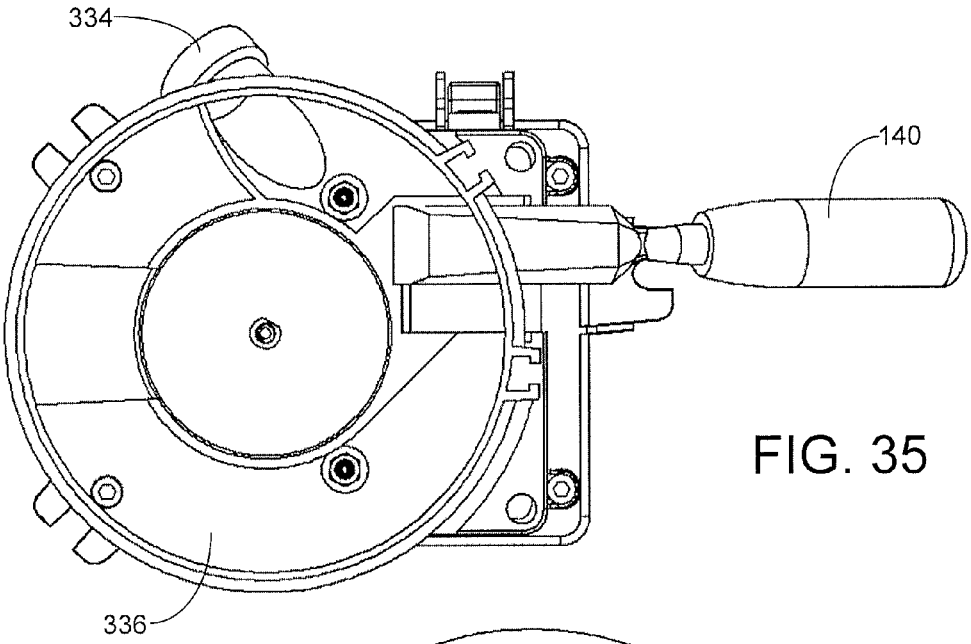
FIG. 35 shows a top plan view of portions of the tool sharpener in accordance with another preferred embodiment in which a vacuum port operates to actively remove heat from the tool.

FIG. 34 shows another preferred embodiment in which a thermo-electric cooler 330 operates as an active heat sink to draw heat from the tool 140 and an underlying tool support 332. Other active cooling approaches can readily be implemented as desired, such as the use of a vacuum port 334 as shown in FIG. 35.

The port 334 is coupleable to a remote pressure source (such as vacuum) and airflow is generated as previously depicted in FIG. 32 to pass adjacent the tool support structure, along a plenum 336 and to the port 334. An advantage of the approach of FIG. 35 is the capture of swarf and other debris generated during the grinding operation by the exiting airflow.

Figure 36:
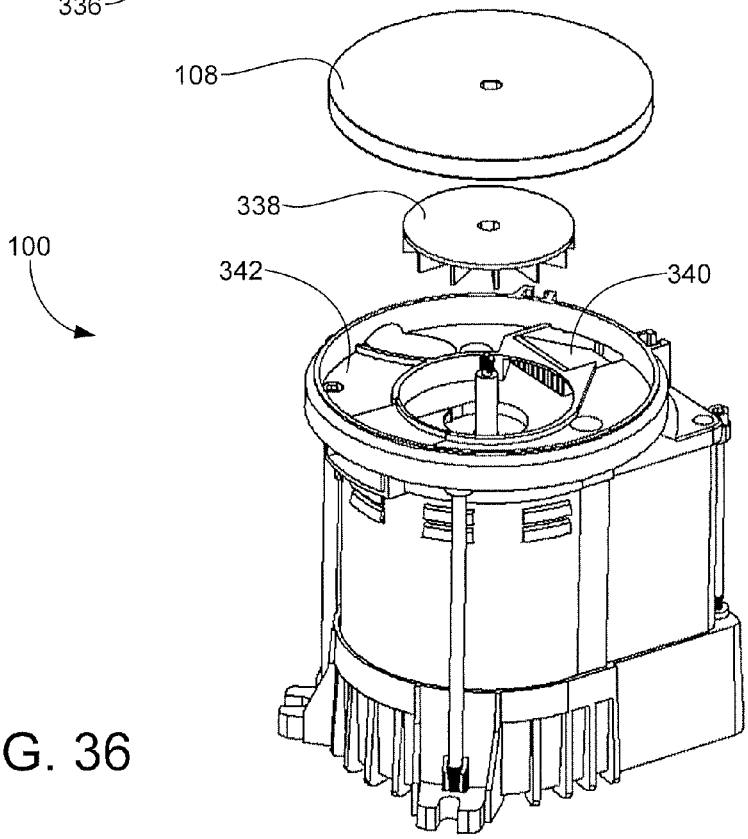
FIG. 36 provides yet another alternative in which an impeller is rotated with the disc to actively remove heat from the tool.

FIG. 36 provides another alternative embodiment in which an impeller 338 is disposed adjacent the disc 108 and rotated during disc rotation. The inlet is adjacent the tool support structure (shown generally at 340) and the outlet can be any desired direction, such as downward as shown in FIG. 36. The tool support structure 340 can be integrally formed as a part of a top member 342 of the sharpener 100 so that, for example, the cooling fins can be cast into the member 342.

Slotted Abrasive Disc

The sharpening port 112 is particularly suited to sharpening tools with a cutting edge that extends substantially linearly across the width of the tool. However, other types of cutting tools can have substantially curvilinearly extending cutting edges, such as generally represented by FIG. 37.

Figure 37:
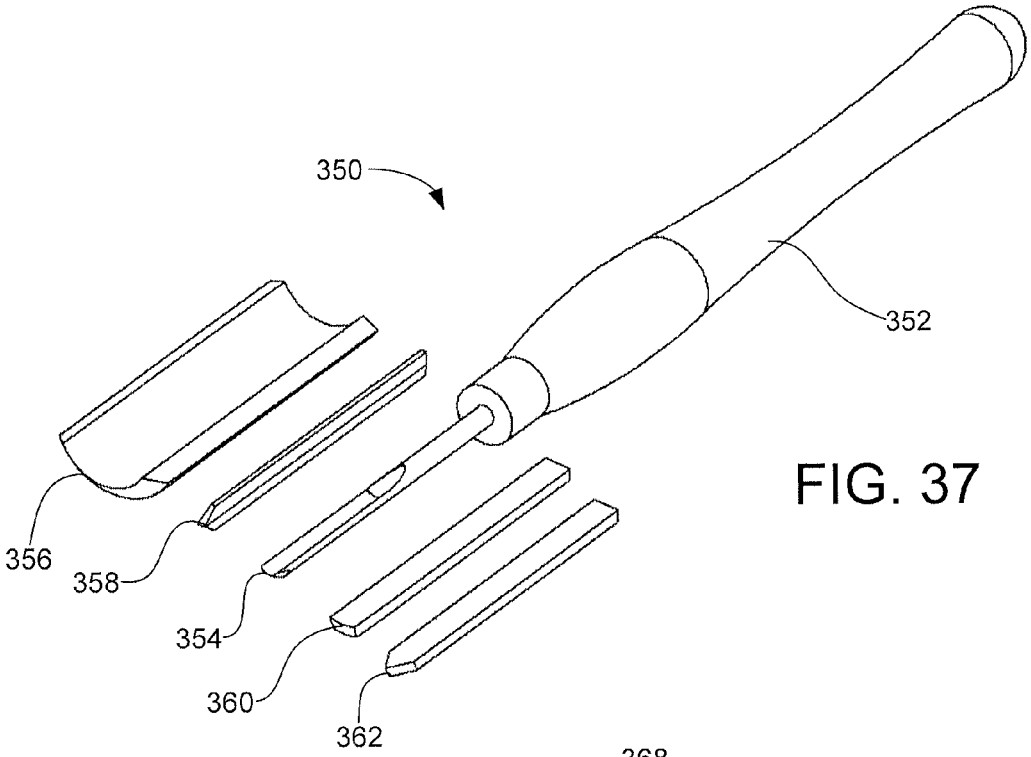
FIG. 37 generally illustrates a class of alternative cutting tools with a number of different types of generally curvilinear cutting surfaces.

More particularly, FIG. 37 provides an exemplary cutting tool 350 with a handle 352 and distal cutting surface 354. As shown by FIG. 37, such tools can come in any number of different shapes and sizes, so that tools such as 350 can alternatively be provisioned with shank portions with respective cutting surfaces 356, 358, 360 and 362. These and other types of curvilinearly extending tools are particularly useful in the woodworking arts for carving, shaving, cutting notches, etc. in wood or other substrate material.

Figure 38:
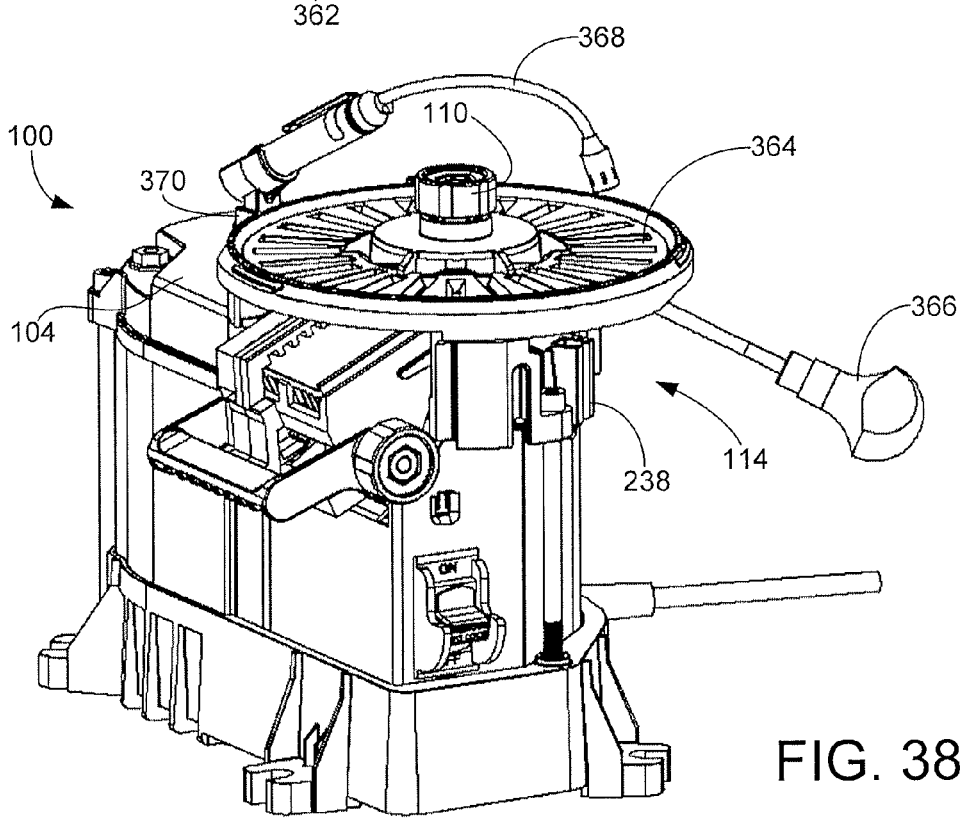
FIG. 38 shows the assembly of FIG. 1 with a slotted abrasive disc and light source to facilitate sharpening of tools of the type generally represented in FIG. 37 in accordance with preferred embodiments.

Such tools are preferably sharpened using the aforementioned port 114 of the tool sharpening assembly 100, as set forth in FIG. 38. This figure shows the use of a second, specially configured rotatable disc 364 in place of the first disc 108 discussed above. As before, the disc 364, herein also referred to as a "slotted disc," is secured to the assembly 100 using removable fastener 110. A cutting tool 366 (generally similar to the class of tools 350 depicted in FIG. 37) can be sharpened by user presentation of the tool at the port 114 against an underlying abrasive surface (not shown) of the slotted disc 364. An overhead light source 368 is preferably attached to the top member 104 via a t-slot 370.

Figure 39:
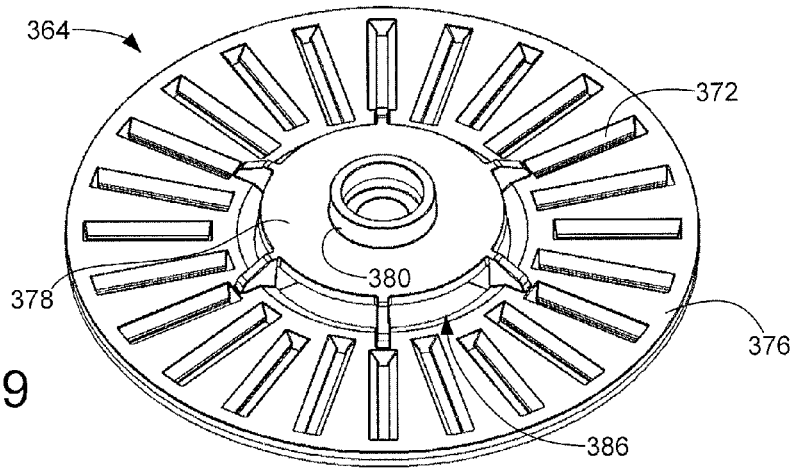
FIGS. 39 and 40 show respective views of the slotted disc of FIG. 38.
Figure 40:
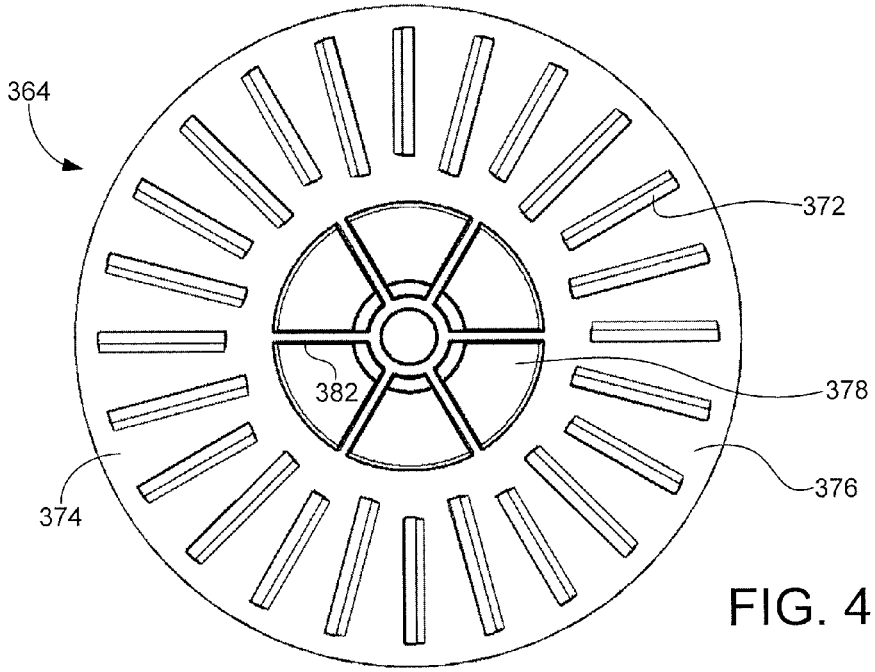

As shown in FIGS. 39 and 40, the slotted disc 364 preferably includes a plurality of radially extending slots (inspection apertures) 372 in spaced apart relation about the disc 364. A layer of abrasive 374, preferably in the form of a coated abrasive with an adhesive backing, is affixed to the underlying surface of the disc. Such is not necessarily required, however; for example, in an alternative embodiment the disc 364 can be provided with a diamond or other abrasive coating or texturing that is directly applied to the disc 364.

Apertures (not separately designated) are formed in the abrasive layer 374 to correspond to the apertures 372, so that a user can see through the disc 364 in the vicinity of the apertures 372.

During rotation of the disc 364 at high speed, a strobe effect is generated which enables the user to observe the grinding operation from above. More specifically, the head of the user is preferably positioned above and over the disc 364 so that the user can observe and control the manipulation of the tool 350, 366 against the abrasive surface 374 from beneath. By holding the tool by the handle, the user can align, pivot and/or rotate the tool continuously along various axes to present the full extent of the cutting edge against the disc 364 to effect the desired sharpening.

Figure 41:
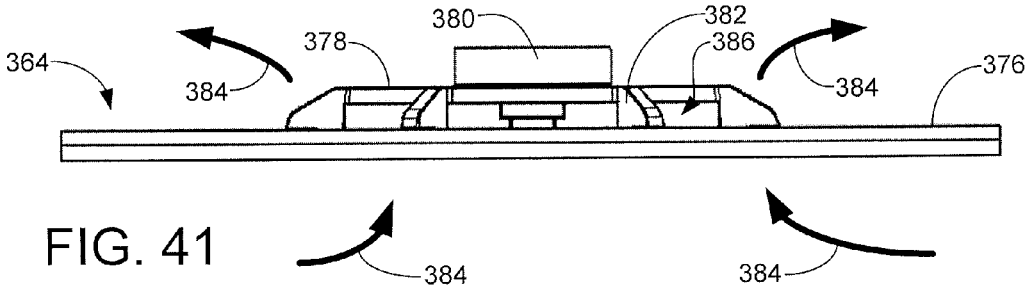
FIG. 41 provides an elevational representation of the slotted disc to represent a preferred cooling airflow generated during rotation of the disc.

As further shown in FIG. 41, the disc 364 preferably includes an outer annular disc portion 376 at a first elevation and an inner annular disc portion 378 at a second, higher elevation. The inner disc portion 378 includes an annular boss 380 to accommodate the fastener 110. A series of radially extending support vanes 382 adjoin the outer and inner disc portions 376, 378.

The support vanes 382 preferably operate to generate airflow currents (denoted by arrows 384) which flow upwardly through gaps 386 between the inner and outer disc portions 376, 378. These airflow currents advantageously serve to provide cooling to the sharpened tool. While the vanes 382 are shown to linearly extend from the center of the disc 364, other configurations, including swept or curved vanes, can readily be employed. The disc 364 is preferably formed of injection molded plastic, although other configurations and constructions can be employed as desired.

Figure 42:
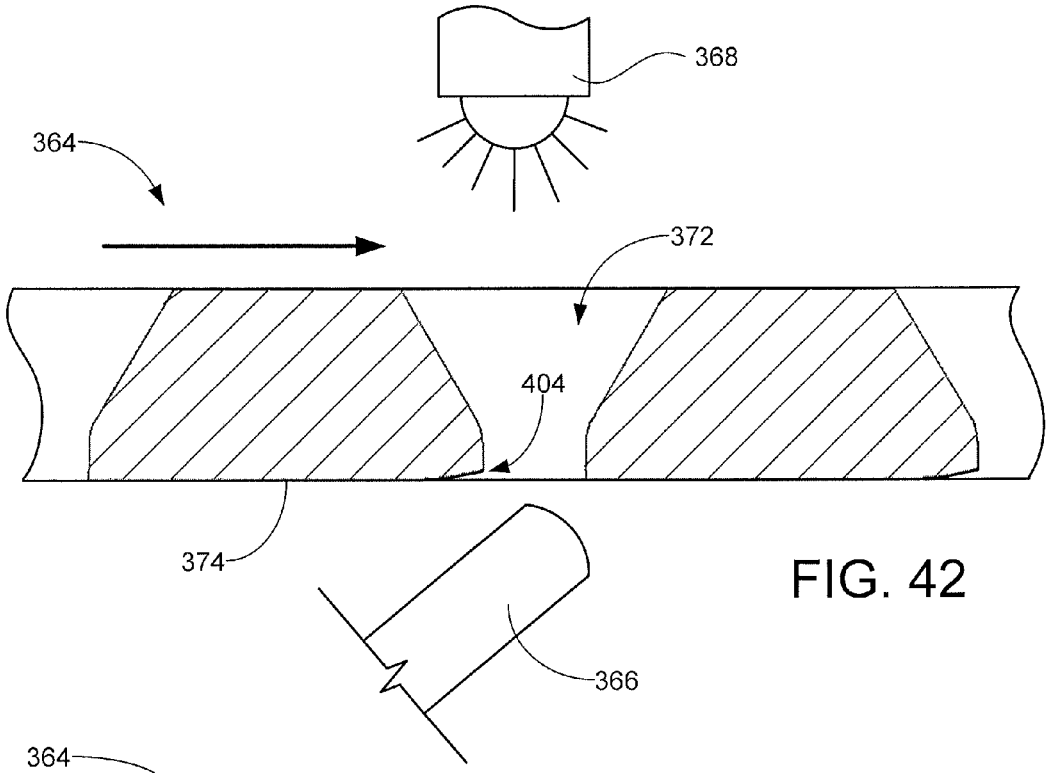
FIG. 42 is a cross-sectional elevational representation of the slotted disc to better illustrate a preferred configuration for the slotted apertures extending therethrough.

FIG. 42 provides a generalized cross-sectional, elevational view of a portion of the disc 364 in conjunction with a selected tool (in this case 366) and light source 368. As shown in FIG. 42, each of the slotted apertures 372 is preferably provided with a substantially "hour-glass" type cross-sectional shape. This advantageously facilitates greater visibility for the user through the disc 364 during operation.

Figure 43:
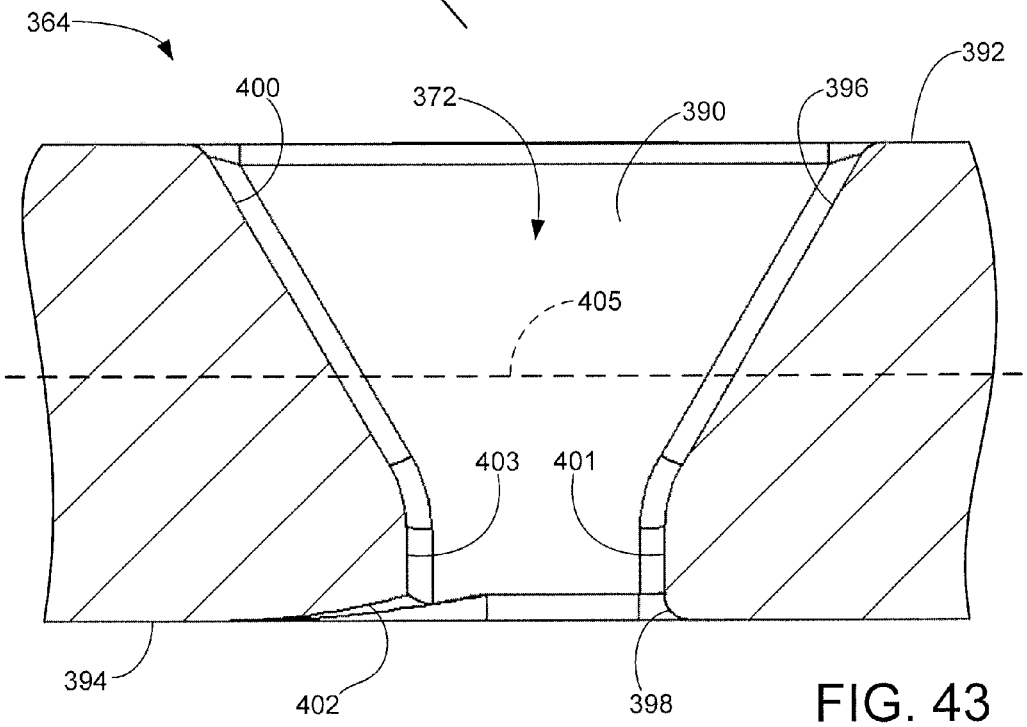
FIG. 43 shows one of the slotted apertures in greater detail.

As further shown in FIG. 43, each aperture 372 is preferably defined by an interior sidewall 390 that extends from an upper surface 392 to a lower surface 394 of the disc 364. The sidewall 390 includes an upper leading edge 396, a lower leading edge 398, an upper trailing edge 400, and a lower trailing edge 402. The aperture 372 is preferably "wider" adjacent the upper surface 392 as compared to the lower surface 394; that is, a maximum separation distance between the upper leading and trailing edges 396, 400 is greater than a corresponding maximum separation distance between the lower leading and trailing edges 398, 402.

This wider opening at the upper portion of the aperture 372 as compared to the lower portion advantageously increases the effective amount of light transmission and reflection through the aperture 372 from the source 368, to the tool 366, and back to the users' eyes. At least the sidewalls 390 and top surface 392 are preferably black or other dark color to further improve light transmission and reflection through the apertures 372.

The lower trailing edge 402 is preferably substantially longer in comparison to the lower leading edge 398, as set forth in FIG. 43. The adhesive layer 374 preferably extends along at least a portion of the lower trailing edge 402, as generally depicted in FIG. 42. In this way, the lower trailing edge 402 serves as a landing zone for the tool 366, and reduces a likelihood of the tool engaging a leading edge surface of the adhesive layer (shown at point 404 in FIG. 42).

With respect to the direction of disc rotation, the separation distance between the upper leading and trailing edges 396, 400 at the upper mouth of the aperture 372 is preferably about 0.272 inches, and the separation distance between the lower leading and trailing edges 396, 400 at the lower mouth of the aperture 372 is preferably about 0.185 inches. Opposing interior medial surfaces are denoted in FIG. 43 at 401 and 403, respectively, and the separation distance between these is preferably on the order of about 0.100 inches. While various other dimensional values can be used as desired, the lower mouth of the aperture 372 is preferably at or below 0.250 inches.

The upper leading and trailing edges 396, 400 preferably meet the respective medial surfaces 401, 403 in the lower half of the aperture 372; that is, the edges 396, 400 extend downwardly beyond a centerline 405 with respect to an overall thickness of the disc 364. The surfaces 396, 400 further are preferably disposed at an angle of about 60 degrees, although other values can be used as desired.

Secondary Grinding Surfaces

The solid, two sided abrasive disc 108 and the slotted disc 364 can be respectively selected and installed onto the assembly 100 to provide a number of sharpening configurations for different types of tools. Additional grinding members can be affixed to the assembly 100 as well.

Figure 44:
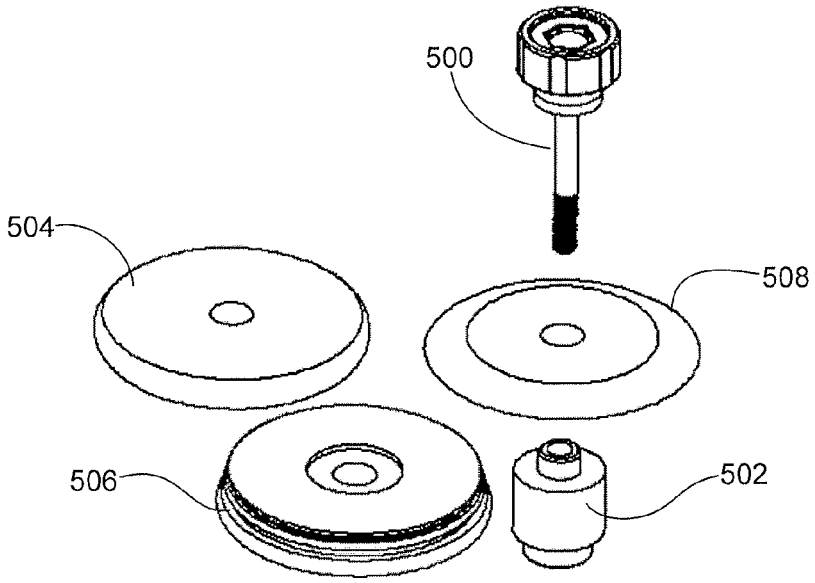
FIG. 44 illustrates a number of different, alternative rotatable abrasive members that can be attached to the assembly of FIG. 1 in accordance with preferred embodiments.

FIG. 44 shows a threaded fastener 500 and cylindrical spacer 502 which can be used to affix any number of different abrasive members for rotation by the motor 124, such as for example members 504, 506 and 508. The abrasive member 504 is substantially disc shaped with a continuously curved outer abrasive surface. The abrasive member 506 has a sequence of stepped outer abrasive surfaces, and the abrasive member 508 has a substantially v-shaped outer abrasive surface.

Figure 45:
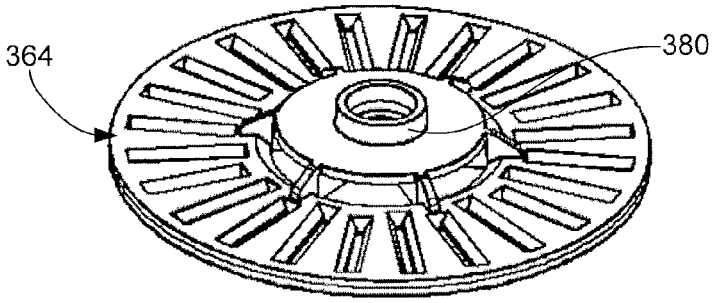
FIG. 45, shows a partially detailed side elevational cross-sectional view of a disc shaped rotational abrasive member of FIG. 44 attached for rotation by the assembly of FIG. 1.
Figure 45:
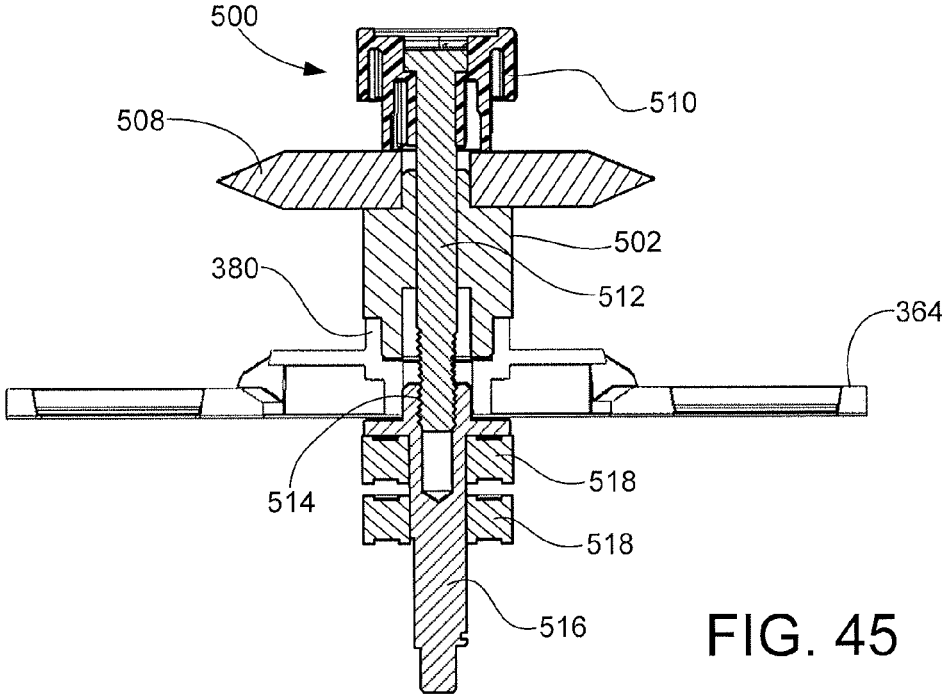

FIG. 45 shows a cross-sectional view of the member 508 in a preferred attachment configuration with the assembly 100. The fastener 500 preferably includes a plastic, user activated knob 510 and a metal threaded bolt 512 which engages a threaded aperture 514 in drive shaft 516. The drive shaft 516 is supported by thrust bearings 518 as shown. The spacer 502 preferably mates with the boss portion 380 of the slotted disc 364, although in other alternative embodiments the spacer 502 can mount to the first disc 108, or be mounted without the use of an intervening disc.

Figure 46:
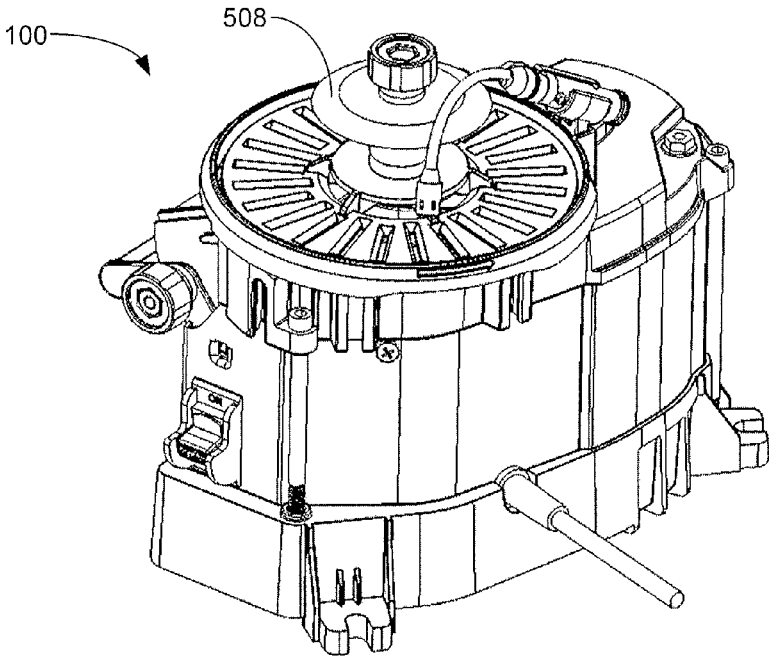
FIG. 46 provides another isometric view of the assembly of FIG. 1 with another one of the abrasive members of FIG. 44 attached thereto.
Figure 47:
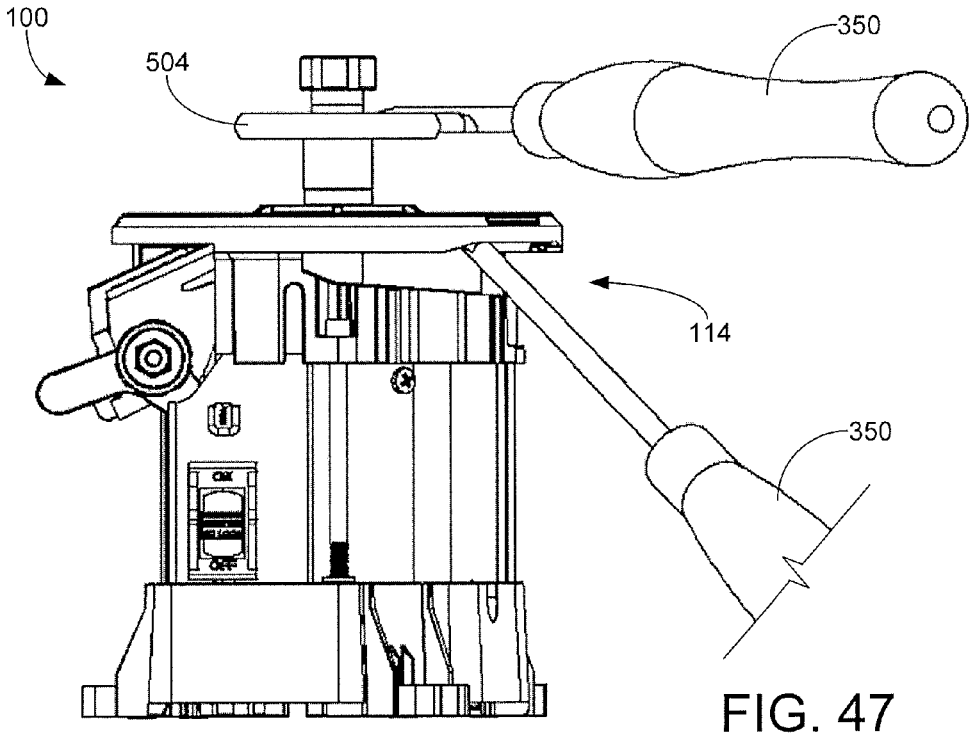
FIG. 47 is a side elevational view of FIG. 32 to show preferred sharpening positions for a tool.

FIG. 46 provides an isometric view of the tool sharpening assembly 100 with the abrasive member 508 mounted as set forth in FIG. 45. FIG. 47 provides an alternative elevational view of the tool sharpening assembly 100 with the abrasive member 504 mounted to the assembly 100. From these figures in can be seen that secondary sharpening and honing operations can be readily made by the user upon the tool 350 using a secondary abrasive member after an initial sharpening operation upon the tool at the sharpening port 114.

Tool Support Attachments

Figure 48:
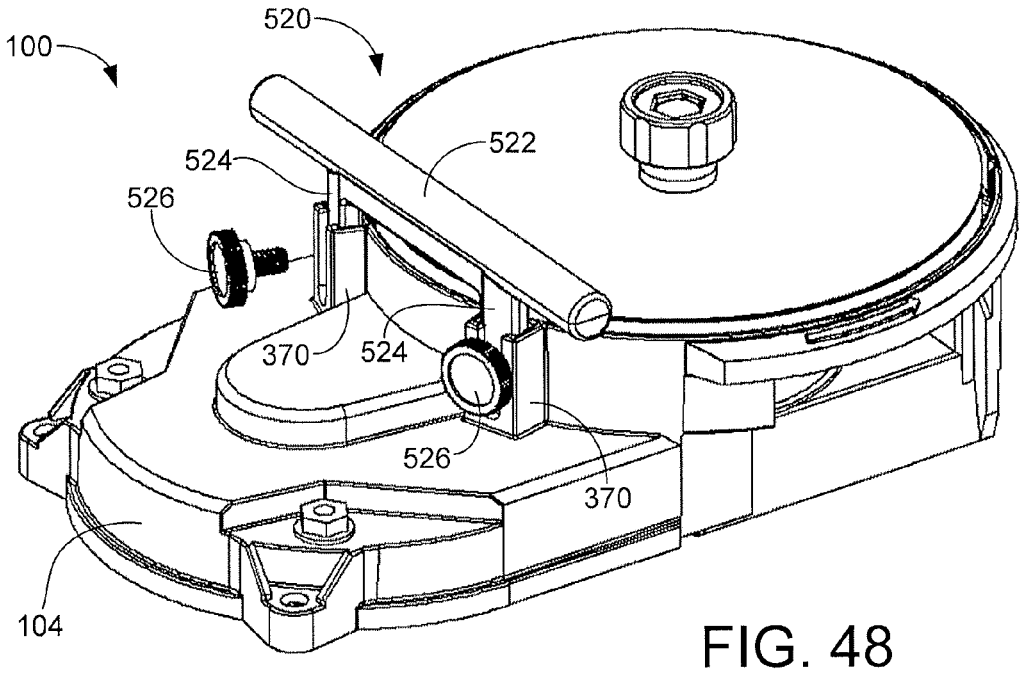
FIG. 48 illustrates a preferred configuration for a tool support bar.

A variety of exemplary tool support attachments are shown in FIGS. 48-57. In FIG. 48, a t-bar support 520 includes a cylindrical, laterally extending support bar 522 that provides a curvilinear support surface to enable the user to present a tool for sharpening against the abrasive member 166 of the disc 108. Support legs 524 are sized to slidingly engage the aforementioned t-slots 370 and to be secured therein with threaded fasteners 526.

Figure 49:
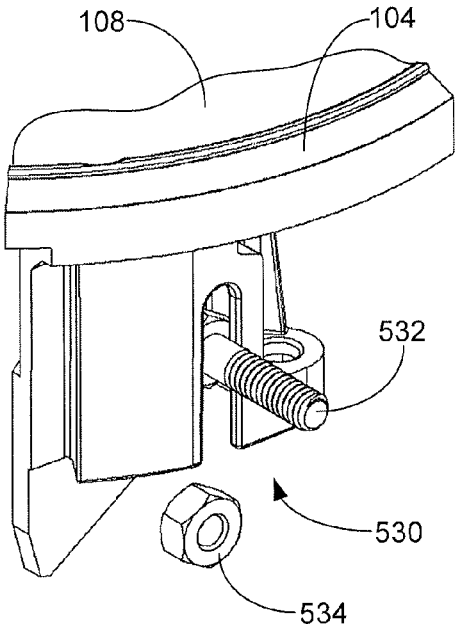
FIG. 49 shows a preferred manner in which t-shaped slots accommodate fastening hardware for fixturing of the assembly of FIG. 1.

FIG. 49 shows another t-slot 530 disposed below the elevation of the disc 108. As with the t-slots 370, the t-slot 530 advantageously facilitates the insertion of conventional hardware such as bolt 532 and nut 534 to affix any number of attachments and/or fixturing to the assembly 100. For example, a handle (not shown) can be threaded onto the end of the bolt 532 to provide a convenient hand-hold for the user to further secure the assembly 100 during sharpening operations.

Figure 50:
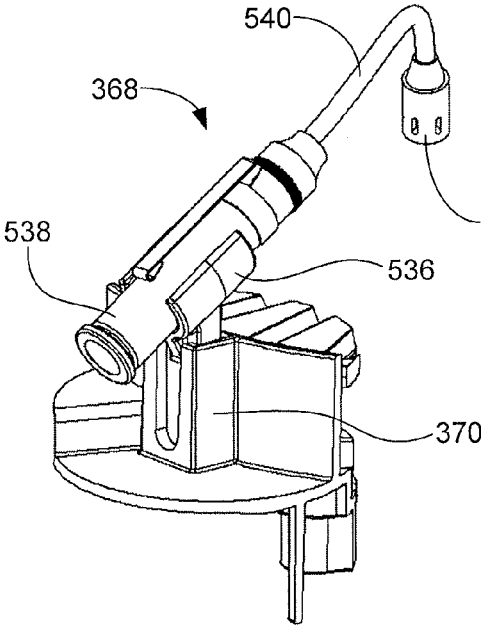
FIG. 50 depicts a preferred attachment of the light source to the top of the assembly of FIG. 1.

FIG. 50 shows the aforedescribed light source 368 supported by a stand member 536 which can be slidingly engaged with a selected one of the t-slots 370.

The light source 368 is preferably characterized as a flexible flashlight type device with a cylindrical base 538 that houses one or more power cells (e.g., AA batteries), a flexible neck 540 and a distal lamp assembly 542. The flexible neck 540 facilitates placement of the lamp assembly 542 in a desired optimal orientation to allow the user to view a grinding operation.

Figure 51:
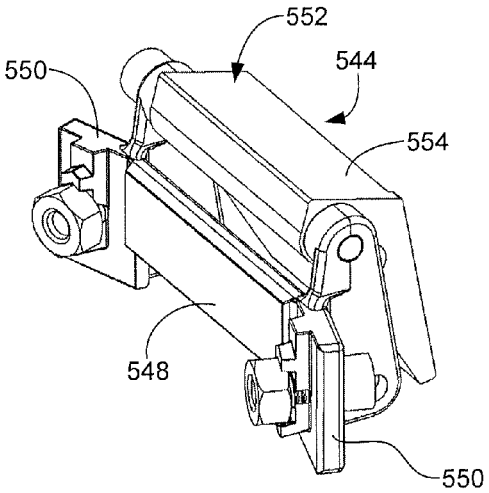
FIGS. 51 and 52 generally represent another tool support assembly.
Figure 52:
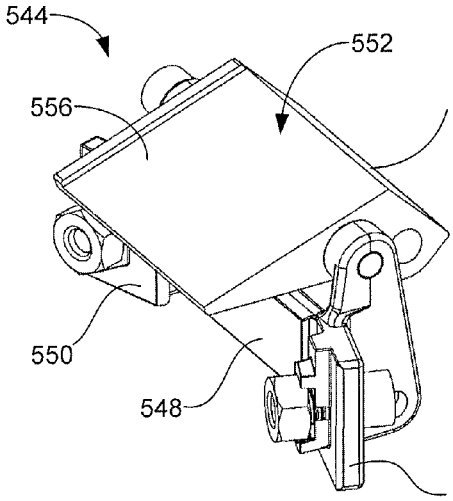
Figure 53:
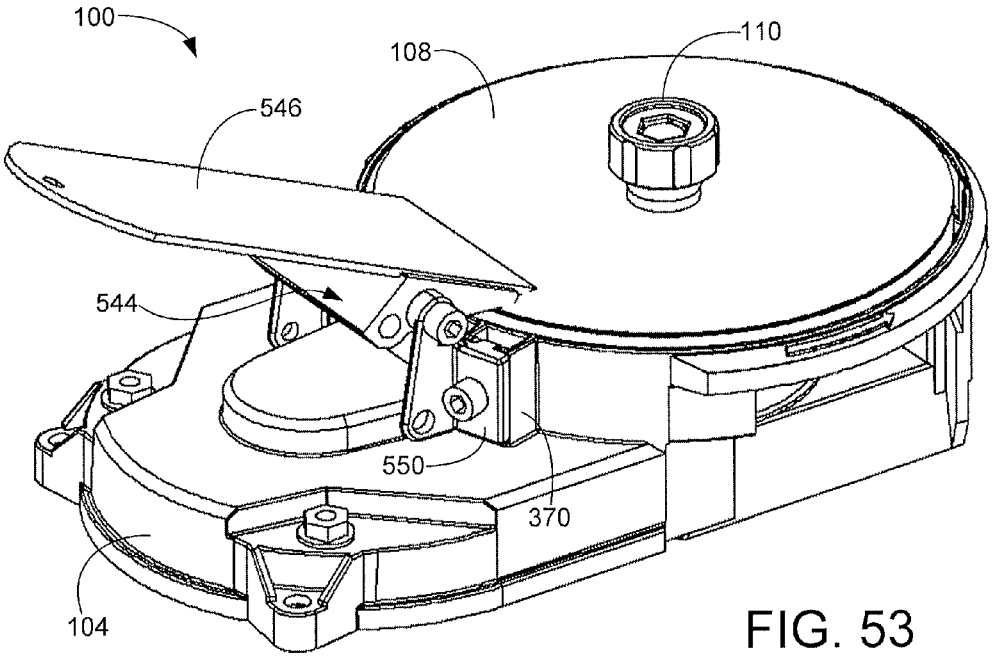
FIG. 53 shows the tool support assembly of FIGS. 51 and 52 supporting a substantially planar tool for sharpening against the top surface of the abrasive disc of FIG. 1.

FIGS. 51 and 52 provide another tool support assembly 544 also configured to support a tool for grinding against the upper abrasive surface 166, as shown by planar tool 546 in FIG. 53. The tool support assembly 544 includes a base 548 with support legs 550 configured to engage the t-slots 370. A wedge-shaped support member 552 is pivotally mounted to the base 548 as shown to respectively present angled tool support surfaces 554 and 556. The wedge-shaped support member 352 is preferably rotated to the desired angular orientation and then tightened to the base 348 via cap screw member. The support surfaces 554, 556 can be smooth or textured with abrasive as desired.

Figure 54:
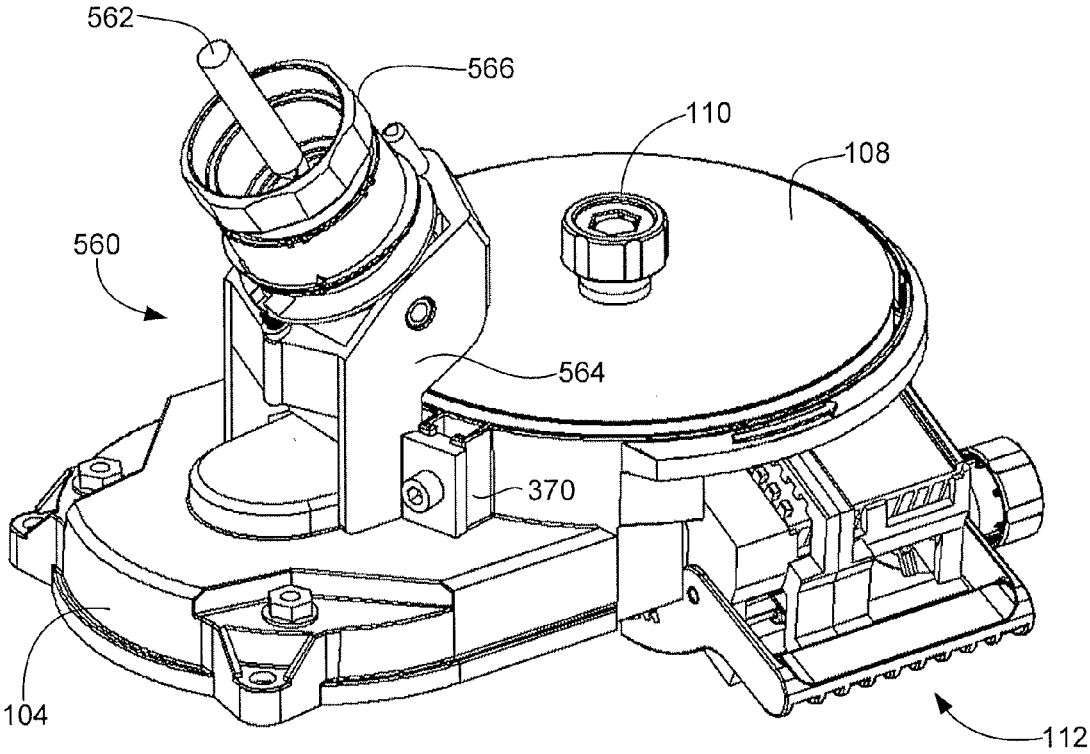
FIG. 54 provides another tool support assembly characterized as a drill bit sharpener.
Figure 55:
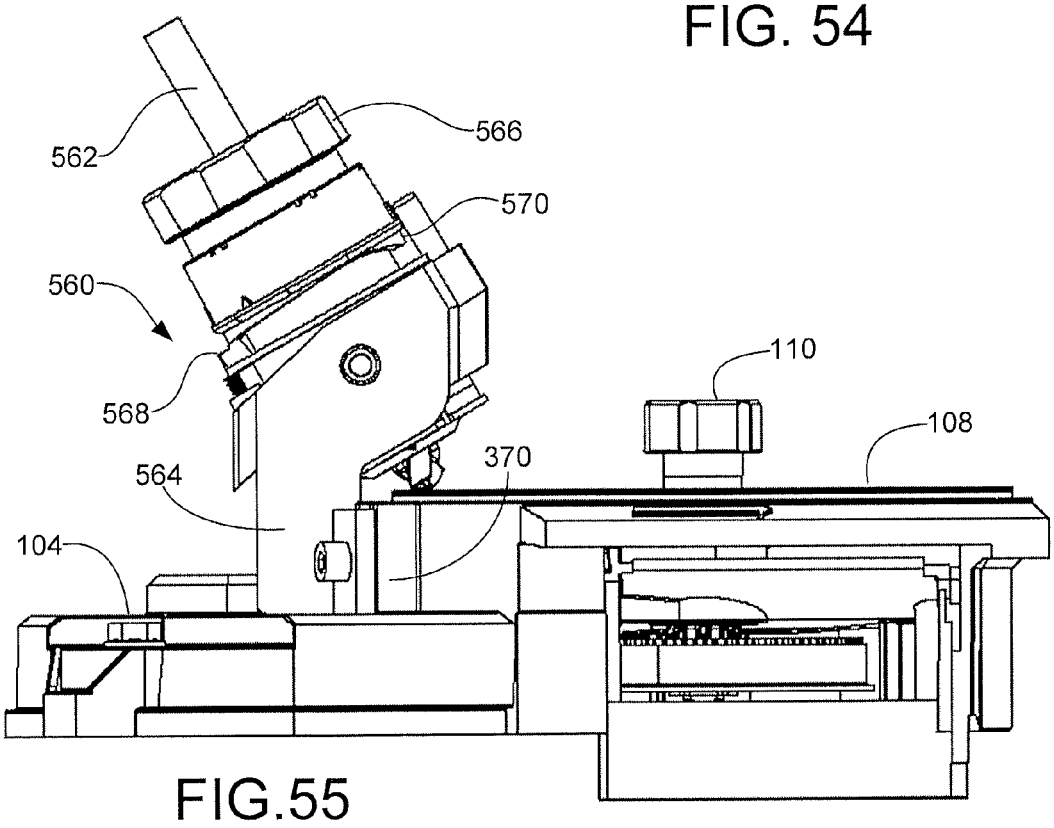
FIG. 55 shows the drill bit sharpener of FIG. 54 in elevation.

FIGS. 54 and 55 illustrate a drill bit sharpener 560 that can also be advantageously mounted to the assembly 100 to sharpen cutting edges of a twist drill bit 562 or similar cutting tool. The drill bit sharpener 560 preferably includes a base support 564 which engages the t-slots 370 as before. The base support 564 defines an insertion port to receive a chuck member 566. Respective camming surfaces 568 and 570 are provided on the base support 564 and chuck member 566 so that the bit 562 can be selectively presented against the abrasive member 166 during user rotation of the chuck member 566 to sharpen the cutting surfaces of the bit.

Figure 56:
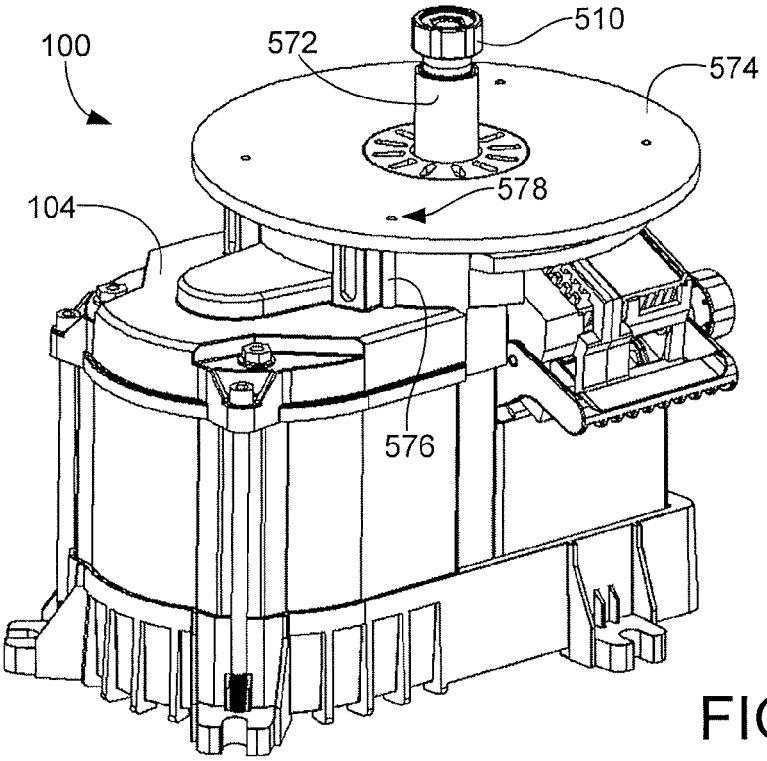
FIG. 56 illustrates a spindle-type abrasive member mounted for rotation by the assembly of FIG. 1 in conjunction with a stationary planar tool support.
Figure 57:
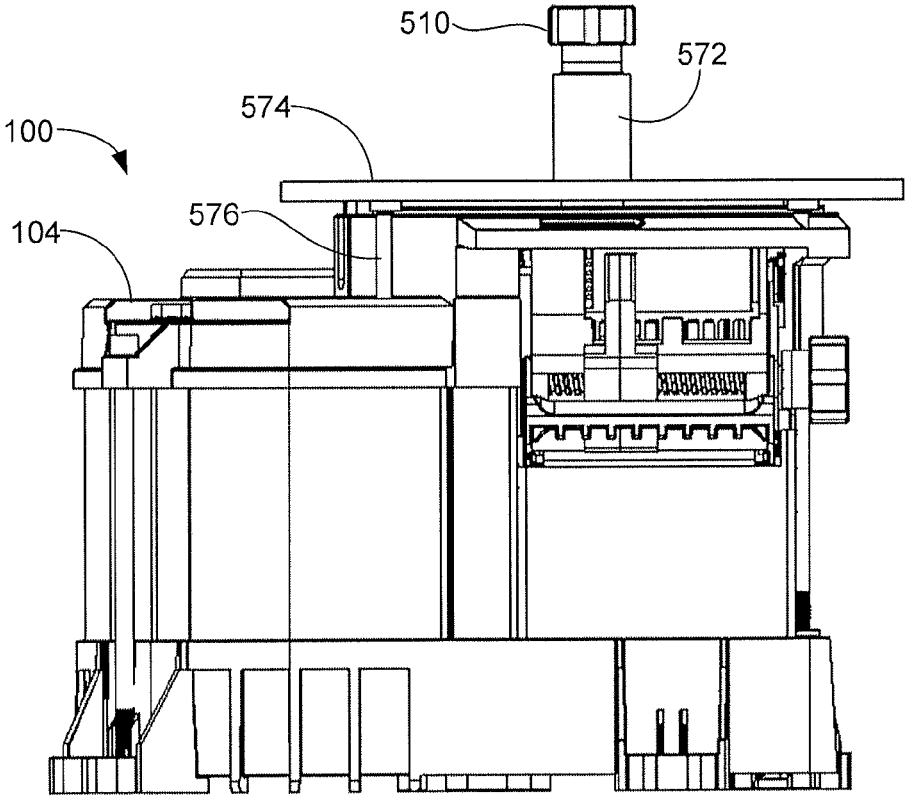
FIG. 57 shows the configuration of FIG. 56 in elevation.

FIG. 56 shows another tool attachment with an abrasive member 572 characterized as a drum, or spindle member. A stationary support plate 574 is preferably disposed about the abrasive member 572 to provide an annular, substantially horizontally disposed support surface for the user. The support plate 574 preferably includes support legs 576 which extend downwardly and rest upon the top member 104. Leveling screws 578 are preferably provided to allow the user to adjust the planar orientation of the plate 574.

In this way, the user can support the tool or other workpiece on the plate 574 to provide abrasion along a direction substantially normal to the plate. For example, the configuration of the assembly 100 in FIGS. 56 and 57 can be used as a drum sander to abrade the edge of a piece of lumber advanced past the abrasive member 572, etc.

Modular Grinding Wheels

As discussed above, the disc 108 is preferably provided with a tempered glass disc substrate to which layers of coated abrasive, such as adhesive backed sandpaper of selected grit, are applied (e.g., layers 156 and 166 shown in FIG. 11). More generally, this technique can be used to provide an abrasive disc (grinding wheel) 580 with multiple abrasive surfaces in a precise and cost effective manner. It will be understood that the abrasive disc 580 can be used with, or apart from, the tool sharpening assembly 100.

Figure 58:
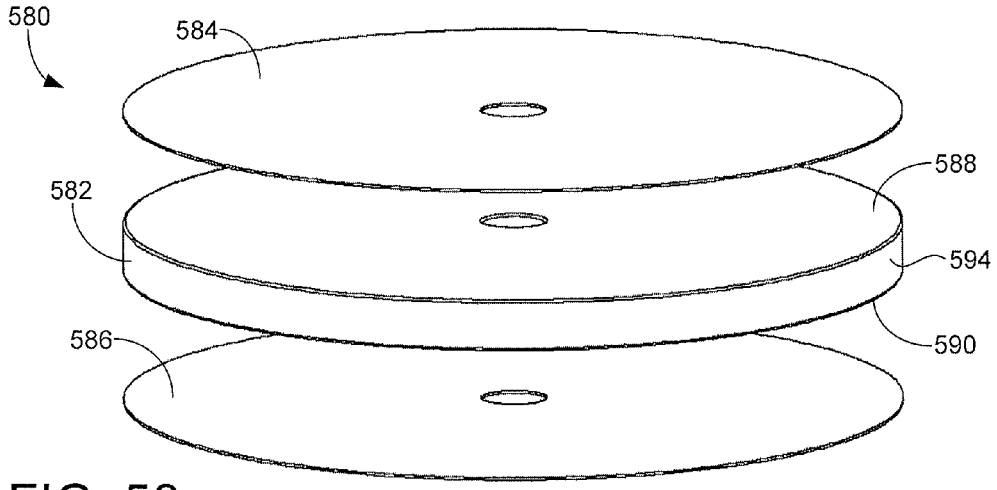
FIGS. 58-60 illustrate a preferred sequence used to form a grinding wheel useful with the tool sharpening assembly of FIG. 1 in accordance with preferred embodiments.
Figure 59:
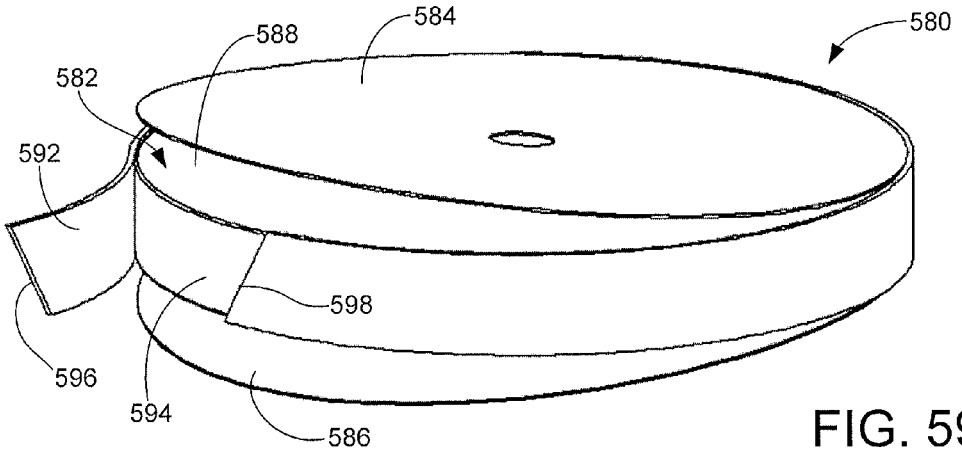
Figure 60:
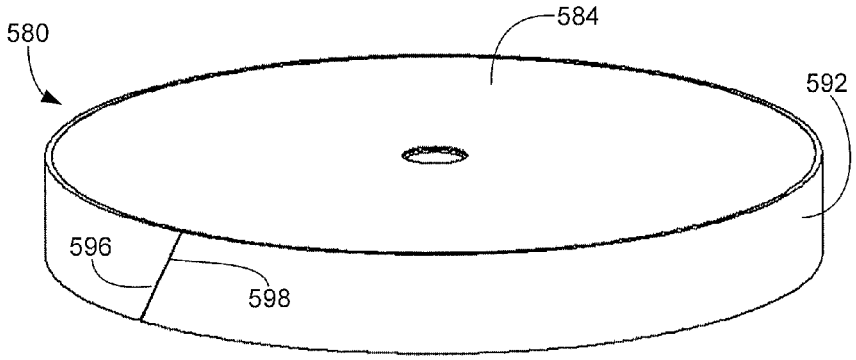

As shown in FIGS. 58-60, a disc shaped substrate 582 is provided. The substrate 582 is preferably formed of tempered glass, but can alternatively be any suitable material including aluminum, stainless steel, molded plastic, etc. Annular abrasive members 584, 586 are affixed to respective opposing face surfaces 588, 590 of the substrate 582 as shown.

An edge abrasive member 592 is further preferably affixed to a circumferentially extending outer surface 594 of the substrate 582 by wrapping the edge member 592 as shown. Mating edges 596, 598 are preferably angled to provide a closely spaced, angled seam joint (FIG. 60).

An advantage of the disc 580 is that any of the respective surfaces can be utilized as a grinding surface in substantially any existing grinding wheel type application. Moreover, unlike prior art grinding wheels which can be brittle or have localized areas of wear over time, the disc 580 is significantly stronger and can be refurbished simply by replacing the abrasive layers with new layers as needed.

Figure 61:
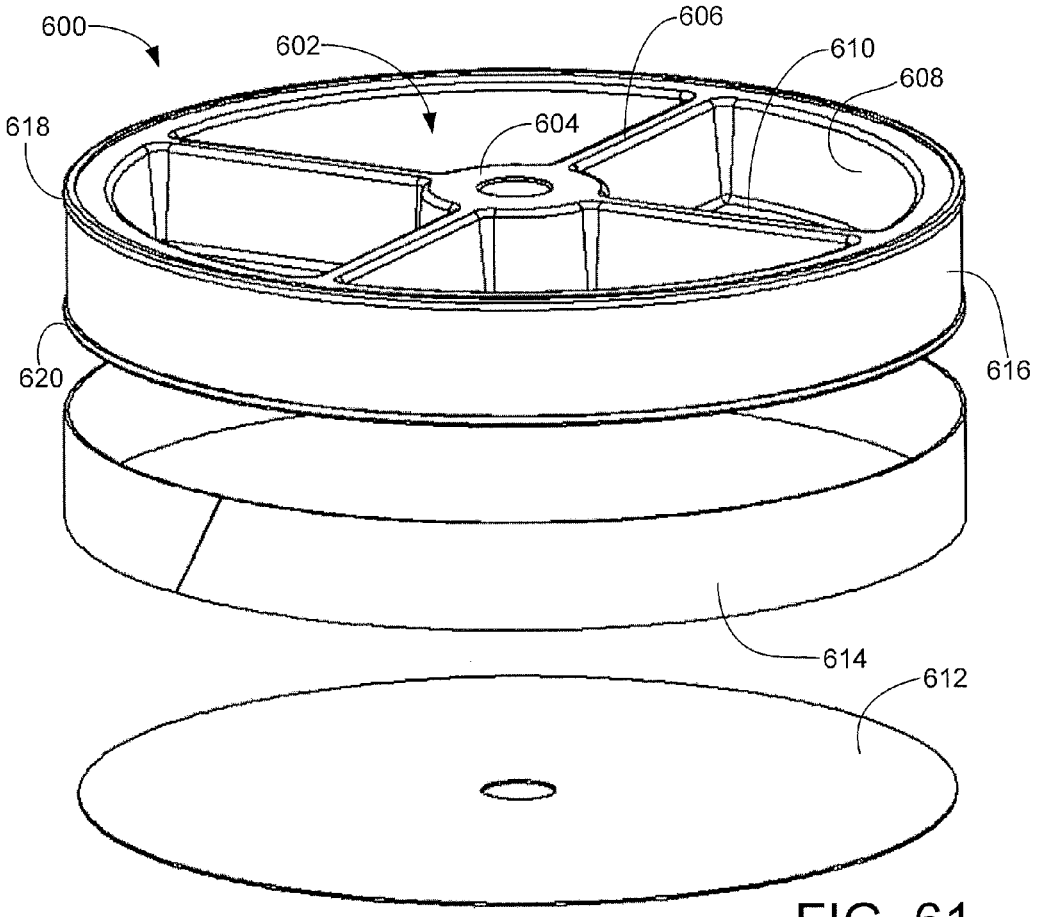
FIGS. 61 and 62 illustrate another preferred sequence for forming a grinding wheel useful with the tool sharpening assembly of FIG. 1 in accordance with preferred embodiments.
Figure 62:
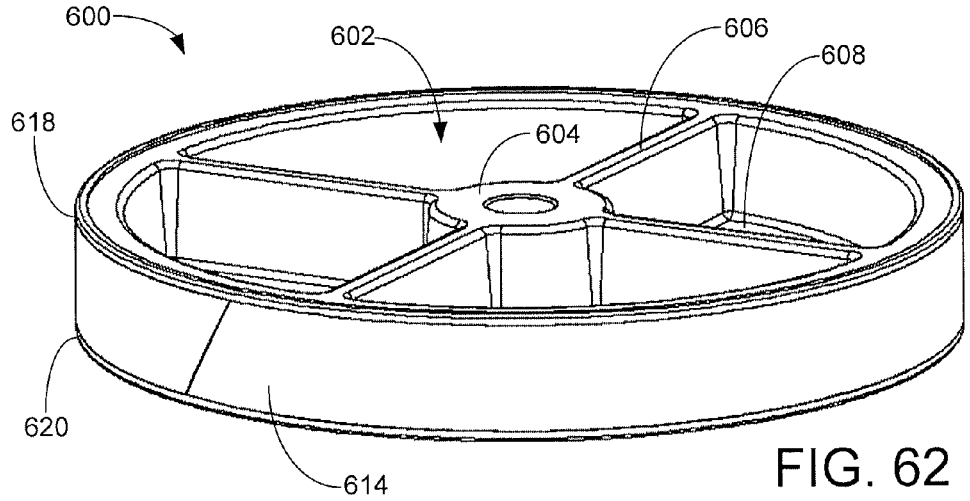

An alternative abrasive disc is shown at 600 in FIGS. 61 and 62. The disc 600 has a substrate 602 preferably formed of cast or machined metal with a central hub 604, radially extending spoke supports 606, and outer annular rim 608. A planar base surface 610 is optionally provided along at least one surface of the substrate (similar to the surface 588 in FIG. 58). Alternatively, the substrate can be provided in multiple pieces with the hub 604, supports 606 and outer rim 608 as a first piece, and then one or more substantially disc shaped members (not separately shown) which are affixed to the first piece.

An adhesive layer 612 is preferably affixed to the planar surface 610, and an edge adhesive layer 614 is affixed to a circumferentially extending outer surface 616 of the rim 608. Annular texturized rings 618, 620 are preferably provisioned at the upper and lower extends of the rim 608. These texturized rings can be provided in any suitable manner, such as through a diamond coating process.

The rings 618, 620 are preferably sized to substantially match the thicknesses of the adhesive layers 612, 614 so that a substantially uniform texture thickness is supplied along the various disc surfaces. An advantage of this configuration is that the abrasive disc 600 has well defined "corner" edges at the joints between to planar and edge surfaces 610, 616, which can be useful in certain types of grinding operations, such as in the application of a split point to a drill bit.

It will now be appreciated that the tool sharpening assembly 100 provides several advantages over the prior art. A variety of different types of cutting tools can be sharpened quickly and efficiently. Extremely sharp cutting edges can be produced with little or no set-up or fixturing time.

It will be noted that the various preferred embodiments discussed herein are directed to a semi-manual system wherein a user manipulates the tool during the sharpening process. While this is preferred, such is not necessarily required or limiting. In further preferred embodiments, a tool can inserted into a given port and an automated reciprocating mechanism cycles the tool until the desired sharpness is achieved.

Similarly, depending on the desired level of throughput, additional or alternative mechanisms can be provided so that one or both of the abrasive surfaces are manipulated to provide the same relative motions as described above. Such mechanisms can be implemented in a variety of ways by the skilled artisan and therefore further explanation of such are not provided for purposes of brevity. However, in view of this unless otherwise indicated it will be understood that reference to the second abrasive member (e.g., FIG. 8) as being "stationary" will not be limited to an absolute sense, but rather will be defined as describing the positioning of the second surface relative to sliding movement of the tool thereagainst.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular environment employed without departing from the spirit and scope of the present invention.

What is claimed is:

1. An apparatus comprising:

a rotatable abrasive surface affixed for rotation about a central shaft;

a tool support structure coupled to the abrasive surface and structurally configured to contactingly support a body portion of a tool while a cutting surface of the tool is presented against the abrasive surface during a sharpening operation; and a cooling mechanism which operates to actively draw heat generated during the sharpening operation through the body portion of the tool and the tool support structure to reduce a temperature of the tool, the cooling mechanism utilizing a cooling fluid which passes adjacent the tool support structure to remove heat from the tool and the tool support structure through conduction, the cooling fluid characterized as ambient air, the tool support structure characterized as a heat sink with a base portion having a tool support surface configured to contactingly support the tool and a plurality of cooling fins which extend from the base portion opposite the tool support surface, the cooling mechanism comprising a rotatable impeller coupled to the central shaft for rotation therewith to direct the ambient air across the cooling fins.

2. The apparatus of claim 1, wherein the tool support surface is characterized as a stationary second abrasive surface through which the heat is conducted from the tool to the cooling fins by the cooling mechanism.

3. The apparatus of claim 2, wherein the base portion of the tool support structure is formed of metal and the stationary second abrasive surface is formed by an abrasive coating layer on the base portion having a thickness significantly thinner than a thickness of the base portion.

4. The apparatus of claim 1, wherein the cooling mechanism circulates the cooling fluid through a closed conduit path.

5. The apparatus of claim 2, wherein the abrasive coating layer comprises at least a selected one of silicon carbide, aluminum oxide, zirconium oxide, paper, polyethelene or an adhesive.

6. The apparatus of claim 1, wherein the impeller comprises a plurality of fins coupled for rotation with the rotatable abrasive surface, wherein the rotation of the impeller structure directs a flow of cooling air adjacent the tool.

7. The apparatus of claim 1, further comprising a motor configured to rotate the abrasive surface about the central shaft, the impeller mounted to the central shaft adjacent the abrasive surface to direct a flow of air adjacent the tool support structure.

8. The apparatus of claim 1, wherein the abrasive surface is affixed to a rotatable disc comprising a plurality of inspection apertures extending therethrough to facilitate a user viewing a tool through the disc during a sharpening operation against the abrasive surface, wherein the disc comprises an inner annular disc portion adjacent a central axis of the disc, and a support vane which connects the inner and outer annular disc portions and which establishes an air current path through a gap between the inner and outer annular disc portions.

9. The apparatus of claim 1, further comprising a motor configured to rotate a disc, wherein the rotatable abrasive surface and the impeller are both affixed to a first side of the disc.

10. An apparatus comprising:

a rotatable disc having opposing first and second planar surfaces, the first planar surface supporting a rotatable abrasive surface, the disc affixed to and rotatable about a central shaft;

a tool support structure coupled to the rotatable disc and configured to contactingly support a body portion of a tool while a cutting surface of the tool is presented against a first radial extent of the abrasive surface during rotation of the disc, the tool support structure characterized as a heat sink with a base portion having a tool support surface configured to contactingly support the body portion of the tool and a plurality of cooling fins which extend from the base portion opposite the tool support surface; and a rotatable impeller mechanism connected to the central shaft for rotation therewith and disposed at a second radial extent of the abrasive surface to generate a flow of cooling air adjacent the tool as the tool is presented against said outer radial extent of the abrasive surface, the impeller arranged to direct the cooling air across the cooling fins to draw heat from the body portion of the tool and through the base portion and cooling fins of the tool support structure.

11. The apparatus of claim 10, wherein the first radial extent comprises an outer radial extent of the abrasive surface and the second radial extent comprises an inner radial extent of the abrasive surface.

12. The apparatus of claim 10, further comprising a motor adapted to rotate the disc and the impeller mechanism at a common rotational velocity about the central shaft, wherein the impeller contacts the first planar surface of the disc.

13. The apparatus of claim 10, wherein the tool support surface is characterized as a stationary second abrasive surface through which the heat is conducted from the tool to the cooling fins, the base portion of the tool support structure is formed of metal having a first thermal conductivity, and the stationary second abrasive surface is formed by an abrasive coating layer on the base portion having a second thermal conductivity less than the first thermal conductivity.

14. The apparatus of claim 10, further comprising a channel adjacent the abrasive surface to direct said flow of cooling air adjacent the cooling fins.

15. The apparatus of claim 10, wherein the impeller mechanism comprises a plurality of angularly spaced apart fins coupled for rotation with the rotatable abrasive surface, wherein the rotation of the angularly spaced apart fins generates the flow of cooling air.

16. The apparatus of claim 10, wherein the abrasive surface is characterized as a first abrasive surface and the apparatus further comprises a second abrasive surface affixed to the opposing second side of the disc.

17. The apparatus of claim 16, wherein the disc can be removed, inverted and reconnected to the impeller mechanism to facilitate presentation of the tool against the second abrasive surface.

18. The apparatus of claim 10, further comprising a motor configured to rotate the disc, wherein the rotatable abrasive surface and the impeller are both affixed to the first planar surface of the disc.

19. The apparatus of claim 13, wherein the abrasive coating layer comprises at least a selected one of silicon carbide, aluminum oxide, zirconium oxide, paper, polyethelene or an adhesive.

20. The apparatus of claim 13, wherein the abrasive coating layer is thinner than the base portion of the tool support structure.

* * * * *